US006016581A

United States Patent [19]

Miki

[11] Patent Number: 6,016,581

[45] **Date of Patent: *Jan. 25, 2000**

[54] SEMI-FLUID MATTRESS

[76] Inventor: Sakae Miki, 5525-9 Ashikajima, Choshi Chiba 288-0005, Japan

[ * ] Notice: This patent is subject to a terminal disclaimer.

[21] Appl. No.: 09/143,278

[22] Filed: Aug. 28, 1998

Related U.S. Application Data

[63] Continuation-in-part of application No. 08/896,300, Jun. 27, 1997, abandoned, and application No. 09/081,704, May 19, 1998.

[51] Int. Cl.[7] ..... A61G 7/057

[52] U.S. Cl. ..... 5/689; 5/702; 5/912

[58] Field of Search ..... 5/614, 615, 698, 5/697, 702, 714, 715, 655.4, 657, 911, 912, 915, 933, 689

[56] References Cited

U.S. PATENT DOCUMENTS

| | | | |
|---|---|---|---|
| 3,840,920 | 10/1974 | Voelker | 5/702 X |
| 4,114,214 | 9/1978 | VonHeck | 5/655.4 X |
| 4,483,029 | 11/1984 | Paul . | |
| 4,599,755 | 7/1986 | Tominaga . | |
| 4,637,083 | 1/1987 | Goodwin | 5/689 |
| 4,686,723 | 8/1987 | Smith | 5/689 |
| 4,768,250 | 9/1988 | Kato | 5/689 |
| 4,794,659 | 1/1989 | Kurita et al. . | |
| 4,942,635 | 7/1990 | Hargest et al. . | |
| 4,951,335 | 8/1990 | Eady | 5/709 |
| 4,967,431 | 11/1990 | Hargest et al. . | |
| 5,008,965 | 4/1991 | Vrzalik . | |
| 5,168,591 | 12/1992 | Hakamiun et al. . | |
| 5,388,291 | 2/1995 | Roux . | |
| 5,539,943 | 7/1996 | Romano | 5/912 X |

*Primary Examiner*—Michael F. Trettel

[57] ABSTRACT

A semi-fluid mattress using a mass of granular material to support a user has reversible transferring means and fluidizing means to locally control the granular material. The reversible transferring and fluidizing means are independently controllable at plural locations along a longitudinal extent or dimension of the mattress, so that each region of the body can be independently cared for. The reversible transferring means is used to achieve fitness for natural posture by controlling the distribution of the accumulative height of the granular material, and transfers the granular material between a transverse middle portion and transverse side portions of the mattress. The fluidizing means is used to achieve small partial oppression by controlling local fluidity of the granular material. In a preferred embodiment, reversible rotary blade devices, placed at spaced locations along a longitudinal dimension of the mattress, are used for the above two means by changing their operational mode. The reversible rotary blade devices each have a shaft with blades, a rotatory axis of the shaft being oriented at an angle of from 60 to 120 degrees relative to a longitudinal axis of the mattress. An arrangement of the blades extends over each of two zones on the shaft, the length of each zone being longer than 25% of the transverse size of the mattress and these zones being located within respective opposite complementary halves of a transverse dimension of the mattress, with screw directions of the blade in the different zones being opposite.

20 Claims, 23 Drawing Sheets

SEMI-FLUID MATTRESS

This is a Continuation in Part Application to U.S. application Ser. No. 08/896,300, filed Jun. 27, 1997, now abandoned and to U.S. Application Ser. No. 09/081,704, filed May 19, 1998, still pending.

BACKGROUND OF THE INVENTION

This invention in general relates to a bed system. More particularly, this invention relates to a semi-fluid mattress for a bed.

In ordinary homes, water mattress and air mattress are widely known as a mattress with small partial oppression. Though these mattresses have a simple structure and are moderate in price, they have some problems which need to be overcome. These problems include several of:

(a) low stability in holding the body, resulting from the nature of fluid;

(b) deterioration of posture, relating to the buoyancy acting on each region of the body;

(c) partial oppression caused by the tension of sealed container for holding the fluid;

(d) lack of ventilation resulting from the sealed container; and (e) thermal disharmony caused by the thermal capacity of a mass of water.

In the medical fields, fluidized beds are used for supporting the patient with little partial oppression. There are some problems associated with using fluidized beds in the home, including several of:

(a) extra weight relating to the buoyancy of the fluidized granular material;

(b) extra energy caused by the thermal conditioning of the pressured air;

(c) deterioration of posture, relating to the buoyancy acting on each region of the body; and (d) nervous controllability in fluidizing the granular material, relating to the aerodynamics.

SUMMARY OF THE INVENTION

It is an object of the present invention to provide a semi-fluid mattress with small partial oppression, fitness for natural posture, stability in holding the user, and possibility of good ventilation, moderately balanced.

It is another object of the present invention to provide a semi-fluid mattress with relatively simple machinery suitable for the fine and firm control of the granular material and also suitable for the family bed with shallow and wide structure.

It is another object of the present invention to provide a semi-fluid mattress with a possibility of reducing the weight.

It is another object of the present invention to provide a semi-fluid mattress which can be installed in a bed as a semi-fluid user supporting system separable or inseparable from the bed.

The semi-fluid mattress of this invention is especially suitable for family use, because it has many desirable features including small partial oppression, fitness for natural posture, stability in holding the user, and possibility of good ventilation.

The semi-fluid mattress of this invention is also suitable for production using automatic machine tools, since it just needs repetition of relatively simple and non nervous apparatus.

The semi-fluid mattress of this invention also gives a benefit of motive power for the sleep, since it really applies powerful machine to the mattress.

Other features and advantage of this invention will be apparent from the description of the preferred embodiments, and from the claims.

DESCRIPTION OF THE PREFERRED EMBODIMENTS

Figure 1:
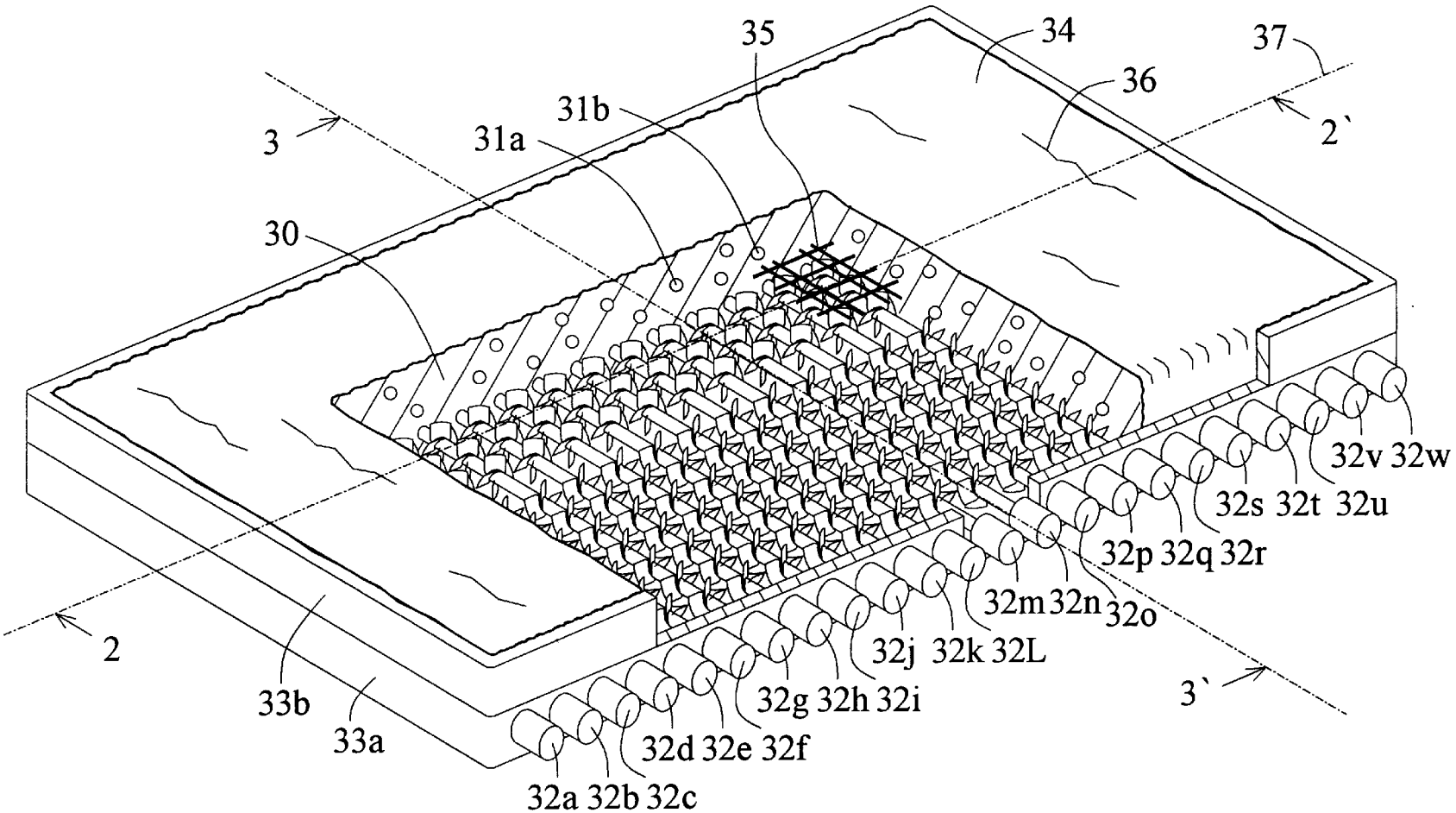
FIG. 1 is a partial cutaway perspective view of a preferred embodiment of a semi-fluid mattress of this invention, illustrating internal granular material and rotary blade devices.
Figure 2:
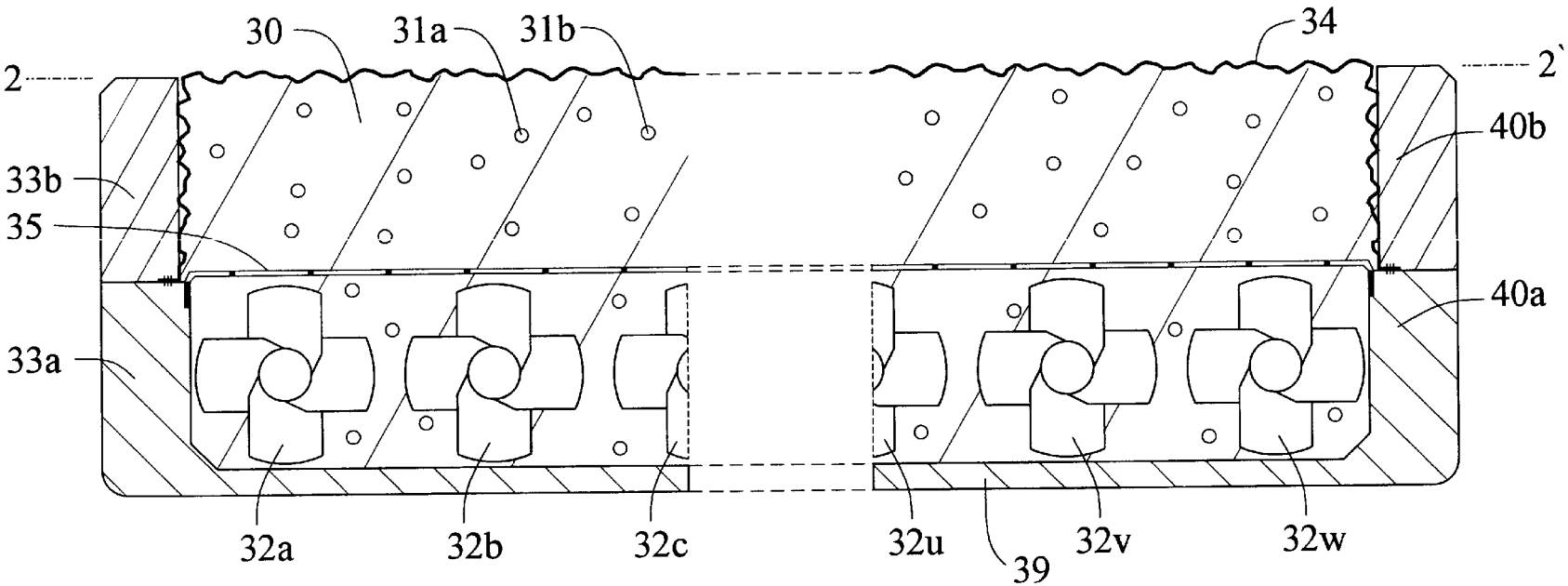
FIG. 2 is a partial vertical sectional view taken on line 2-2' of FIG. 1.
Figure 3:
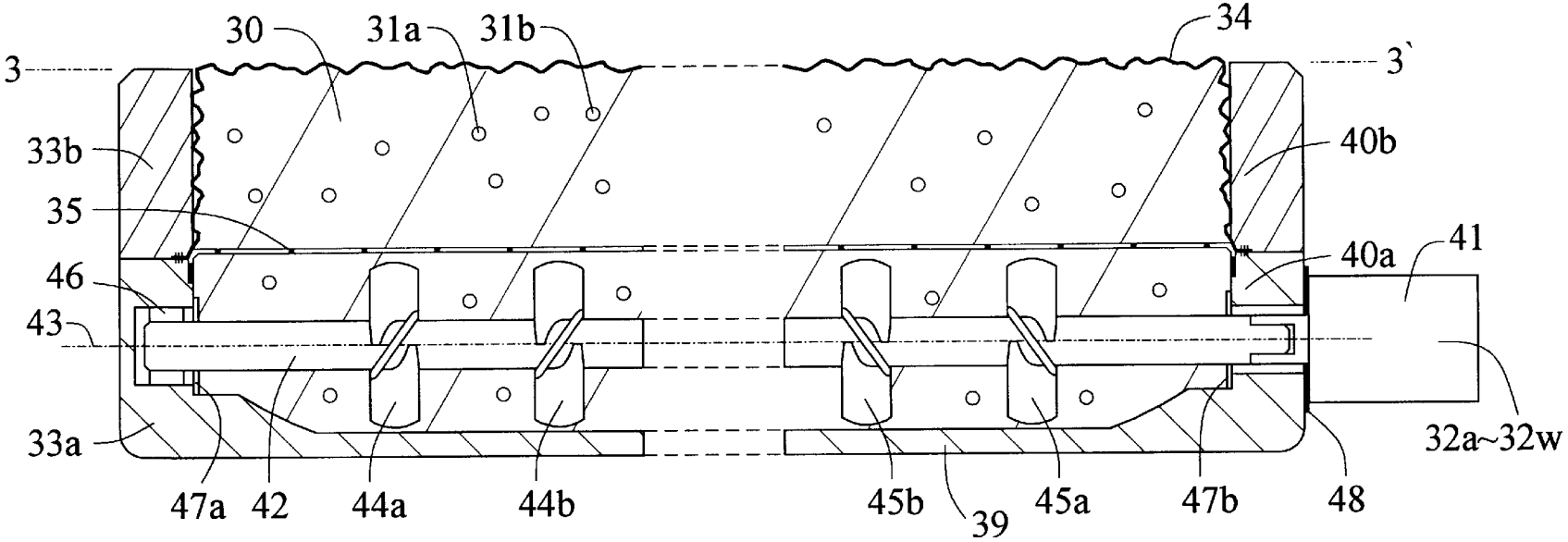
FIG. 3 is a partial vertical sectional view taken on line 3-3' of FIGS. 1, 12 and 16.
Figure 4:
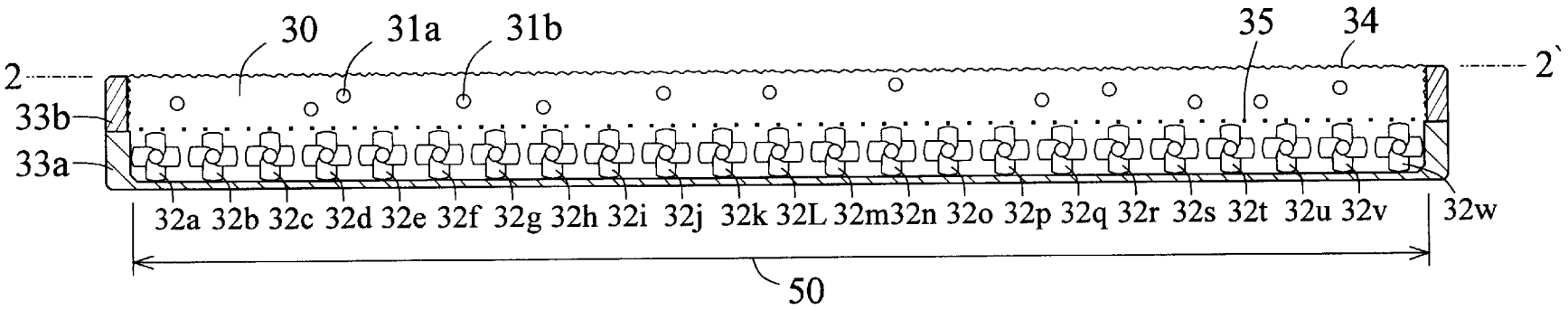
FIG. 4 is a schematic vertical sectional view taken on line 2-2' of FIG. 1.

FIGS. 1~11 illustrate the first preferred embodiment of a semi-fluid mattress of this invention. As illustrated in FIGS. 1, 2 and 3, the semi-fluid mattress of this embodiment comprises a frame 33*a*~33*b* having a floor 39 and a wall 40*a*~40*b*, a mass of granular material 31*a*~31*b* disposed in the flame 33*a*~33*b*, means for fluidizing the granular material 31*a*~31*b*, and means for transferring the granular material 31*a*~31*b*. An air permeable sheet 34 is connected to the wall 40*a*~40*b* of the frame 33*a*~33*b*. The semi-fluid mattress supports the user on the granular material 31*a*~31*b* through the air permeable sheet 34. If ventilation through the granular material 31*a*~31*b* is not necessary, an air impermeable sheet can be used instead of the air permeable sheet 34.

The frame 33*a*~33*b* is composed of a base frame 33*a* and a cushion frame 33*b*. The base frame 33*a* holds the machinery 32*a*~32*w* and fixes the hem of the air permeable sheet 34. The machinery 32*a*~32*w* controls the granular material 31*a*~31*b* finely and firmly, and assists the user in obtaining an appropriate supporting condition in each region of his body. A safety net member 35 protects the user from the machinery 32*a*~32*w*. The cushion frame 33*b* surrounds the air permeable sheet 34 and provides a soft feel for the user.

The granular material 31*a*~31*b*, such as solid grains or the like, behaves as a semi-fluid 30 and operates in a stationary state, in a grainy state, and in a fluent state. The term "semi-fluid" as used herein is an alias of the granular material 31*a*~31*b* based on its function.

By nature, the semi-fluid mattress has a possibility for good ventilation and a holding stability of the user in the stationary state. In order to further obtain small partial oppression and fitness for natural posture, as illustrated in FIGS. 1, 2, 3, 4, 5 and 7, this embodiment uses:

(1) means for fluidizing the granular material 31*a*~31*b*, the fluidizing means independently controlling the fluidizing of the granular material 31*a*~31*b* at more than one place along a longitudinal dimension 50 of the frame 33*a*~33*b*; and (2) means for transferring the granular material 31*a*~31*b* reversibly between a transverse middle portion 54 and transverse side portions 55*a* and 55*b* of the frame, the transferring means independently controlling the transferring of the granular material 31*a*~31*b* at more than one location along a longitudinal dimension 50 of the frame 33*a*~33*b*.

The above places and locations can overlap each other. In this embodiment, the transferring means functions as means for adjusting an accumulative height 53 of the granular material 31*a*~31*b* in a transverse middle portion 54 of the frame 33*a*~33*b*. The adjusting means independently controls the adjusting of the accumulative height 53 of the granular material 31*a*~31*b* at more than one location along a longitudinal dimension 50 of the frame 33*a*~33*b*.

The mattress uses the fluidizing means to obtain small partial oppression by locally fluidizing the granular material 31*a*~31*b* in the places corresponding to each region of the body. Also it uses the transferring means (or adjusting means) to fit to natural posture by changing a distribution of supporting height 52 in the locations corresponding to each region 51. The term "partial oppression" as used herein is intended to represent the concentration of pressure in the narrow area on the surface of the body in supporting his weight, generally depending on the surface shape of the mattress. The term "fitness for natural posture" as used herein is intended to represent fitting adaptively to a medically natural posture in sleeping or to a posture desired by the user. As for a pressure distribution on the surface of the body, the reduction of partial oppression corresponds to an equalization of the pressure in a local area, and the fitting to natural posture corresponds to a redistribution of the pressure in a global area.

The fluidizing means and the transferring means (or adjusting means) can be realized under two kinds of apparatus. However, in this embodiment, to simplify the structure of the machinery, these means are realized under one kind of apparatus which is applicable to both means by changing its operational mode. This apparatus is a rotary blade device as called herein. In other word, the fluidizing means and the transferring means jointly comprise the rotary blade devices.

A plurality of rotary blade devices 32*a*~32*w* are supported by the frame 33*a*~33*b*. Preferably, the rotary blade devices 32*a*~32*w* should be installed in an array near the bottom of the frame 33*a*~33*b*. The rotary blade devices 32*a*~32*w* are located within a longitudinal dimension 50 of the frame 33*a*~33*b*. Preferably, each of the rotary blade devices 32*a*~32*w* should be independently controlled so that each region of the body may be independently cared for. Each of the rotary blade devices 32*a*~32*w* includes:

(1) a shaft member 42 rotatable on a rotatory axis (i.e. axis of rotation) 43 having an angle of from 60 to 120 degrees, preferably from 80 to 100 degrees and desirably 90 degrees, relative to a longitudinal axis 37 of the frame 33*a*~33*b*, the rotatory axis 43 defining a transfer direction 63*a* as a direction which at least partially includes the rotatory axis 43; and (2) a blade member 60*a* connected to the shaft member 42, the blade member 60*a* moving the granular material in the transfer direction 63*a* when the blade member 60*a* rotates on the rotatory axis 43.

The term "rotary blade devices are located within a longitudinal dimension of the frame" as used herein does not mean that the rotary blade devices 32*a*~32*w* should fill up the longitudinal dimension 50 of the frame 33*a*~33*b*. As the blade member 60*a*, for example, a sole blade and a continuous blade are usable. Also, each of the rotary blade devices 32*a*~32*w* can include the blade member 60*a* as an impeller member 44*g* composed of the blade members 60*a*~60*d*.

As illustrated in FIGS. 3, 5, 6 and 7, each of the rotary blade devices 32*a*~32*w* includes left-handed impeller members 44*a*~44*g* and right-handed impeller members 45*a*~45*g*. Each of the left-handed impeller members 44*a*~44*g* is composed of the blade members 60*a*~60*d* with left-handed screw direction, and each of the right-handed impeller members 45*a*~45*g* is composed of the blade members 61*a*~61*d* with right-handed screw direction. An arrangement of the left-handed impeller members 44*a*~44*g* extends over a left zone 56 on the shaft member 42, and an arrangement of the right-handed impeller members 45*a*~45*g* extends over a right zone 57 on the shaft member 42.

Figure 5:
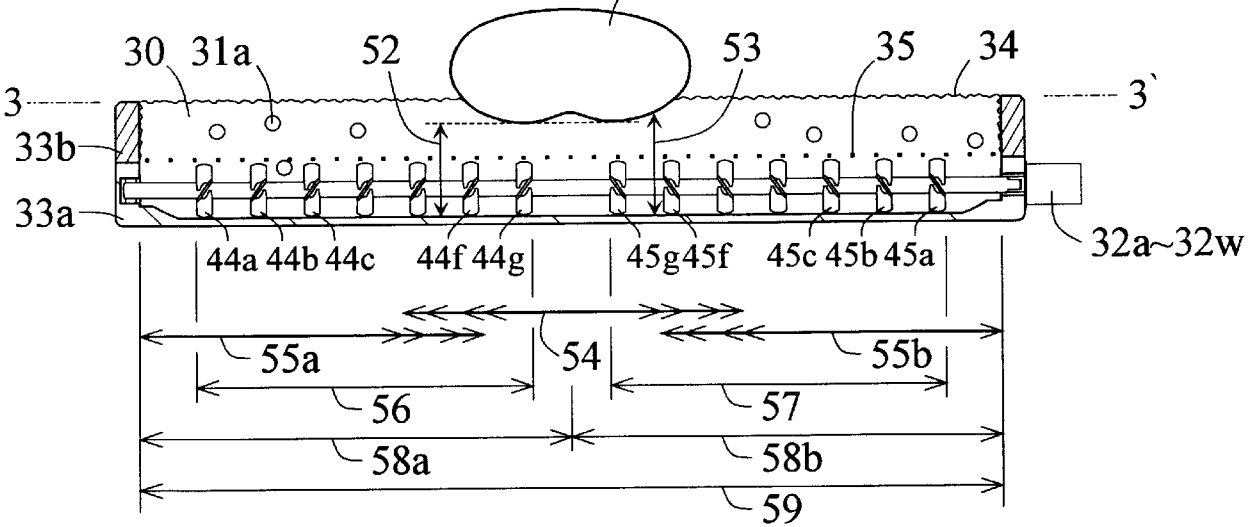
FIG. 5 is a schematic vertical sectional view taken on line 3-3' of FIGS. 1, 12 and 16, illustrating the condition of supporting the user.

As illustrated in FIGS. 3 and 5, the frame 33*a*~33*b* defines a zone 56 on the shaft member 42 having a transverse dimension which is at least 25% (i.e. a quarter) of a transverse dimension 59 of the frame 33*a*~33*b* and is located within a complementary half 58*a* of the transverse dimension of the frame 33*a*~33*b*, and, preferably, an arrangement of the blade members of the impeller members 44*a*~44*g* should extend over the zone 56. Preferably, the blade members of the impeller members 44*a*~44*g* located within the zone 56 should have a uniform 63*a* (i.e. either of left-handed or right-handed) screw direction 62*a*.

Preferably, the blade member of the left-handed impeller members 44*a*~44*g* located within the left zone 56 and the blade member of the right-handed impeller members 45*a*~45*g* located within the right zone 57 should have opposite 63*a* and 63*b* (i.e. left-handed and right-handed) screw directions 62*a* and 62*b* when the zones 56 and 57 are located within opposite complementary halves 58*a* and 58*b* of the transverse dimension of the frame 33*a*~33*b*.

Figure 7:
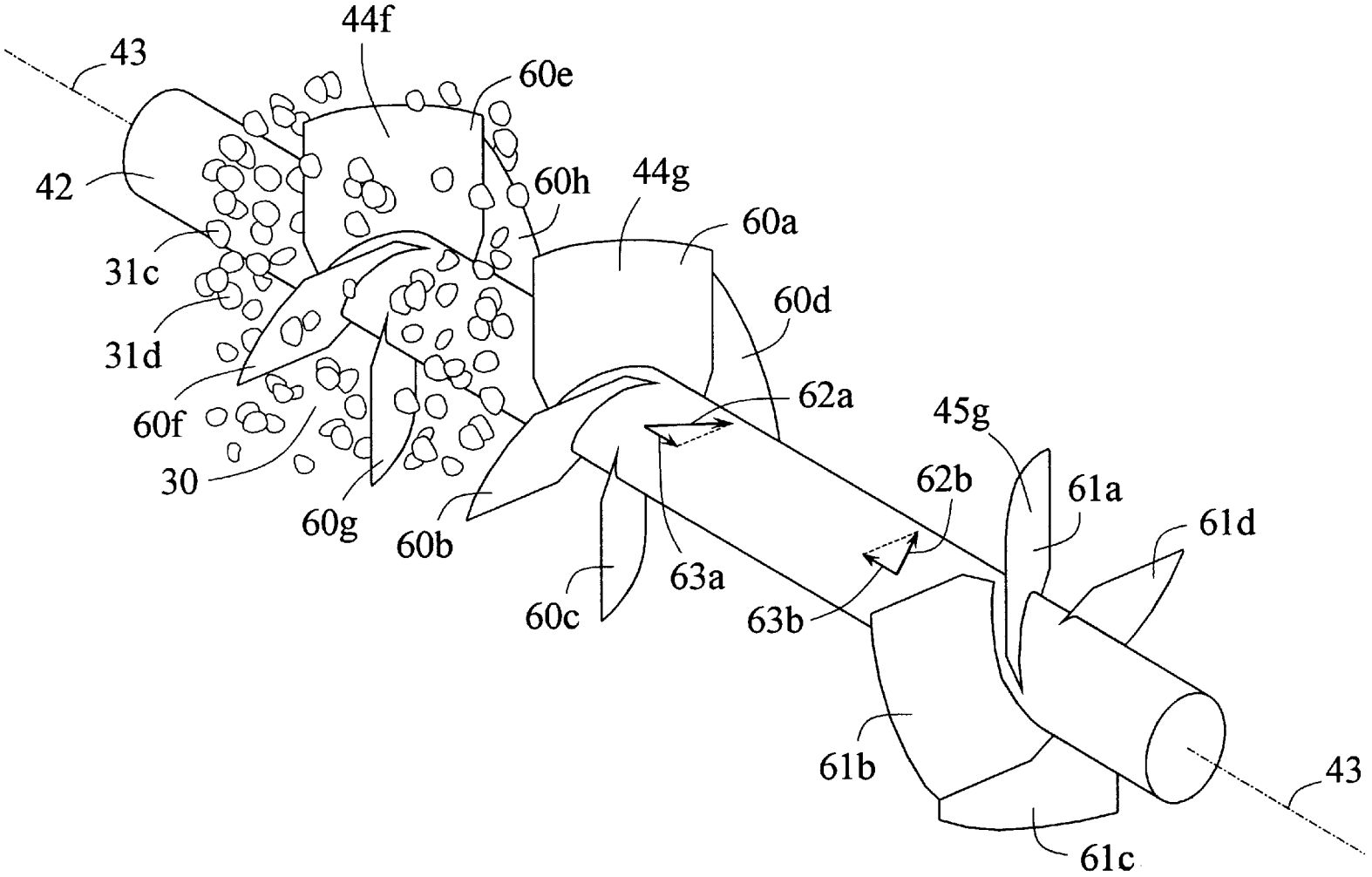
FIG. 7 is an enlarged partial perspective view of rotary blade device within granular material.

Preferably, the zone 56 defines a blade union including all of the blade members of the impeller members 44*a*~44*g* located within the same zone 56, and the blade union should move the granular material 31*a*~31*b* passing through that zone 56 when the all of the blade members rotate on the rotatory axis 43. Substantially, the transferring means reversibly moves (or transfers) the granular material 31*a*~31*b* mainly in a direction having an angle of from 60 to 120 degrees relative to a longitudinal axis 37 of the frame 33*a*~33*b*, passing through the zone 56. FIG. 7 illustrates the granular material 31*c* 31*d* around the left-handed impeller member 44*f* and the shaft member 42. Preferably, the size of the blade members 60*a*~60*h* should be much larger than the size of the granular material 31*c*~31*d*.

As illustrated in FIGS. 3 and 5, preferably, each of the rotary blade devices 32*a*~32*w* should further include means for rotating the shaft member 42 reversibly. Preferably, the rotating means should include a driving motor 41 connected to the shaft member 42. The driving motor 41 rotates the impeller members 44*a*~44*g* and 45*a*~45*g* clockwise, counterclockwise, and alternately clockwise and counterclockwise. The alternate rotation of the impeller members 44*a*~44*g* and 45*a*~45*g* includes unbalanced rotation, for example, such as turning twice clockwise after turning once counterclockwise. Operation of each of the rotary blade devices 32*a*~32*w* is independently controlled, by the user, including the following operations: start, stop, rotating direction, and preferably rotating speed. The user can use some kind of remote-control apparatus for controlling the rotary blade devices 32*a*~32*w*.

The rotary blade devices 32*a*~32*w* are fixed to the base frame 33*a* by a receptacle bearing 46, seals 47*a*~47*b*, and fringe 48 of the driving motor 41 so that the shaft member 42 may be supported substantially in the frame 33*a*~33*b* to be rotatable on the rotatory axis 43. Preferably, the rotary blade devices 32*a*~32*w* should be prepared severally for each main region of the body including a head, shoulder, waist, hip, thigh and foot. An installing space between the adjoining rotary blade devices 32*a*~32*w* can be varied.

Preferably, to protect the machinery from a surge strain caused by the local pressure in the semi-fluid mattress, main portion of the shaft member 42 and the impeller members 44*a*~44*g* and 45*a*~45*g* should have resilient structure or be formed with elastic material such as a hard rubber component. Preferably, the mesh size of the safety net member 35 should be much larger than the size of the granular material 31*a*~31*b* so that the moving of the granular material 31*a*~31*b* may not be obstructed by the safety net member 35. Preferably, the air permeable sheet 34 should have little tension and big leeway as shown by wrinkles 36 to reject a partial oppression caused by the tension of the air permeable sheet 34, as illustrated in FIG. 1. The term "fluidizing the granular material" as used herein is intended to represent flowing (or drifting) the granular material 31*a*~31*b* so that the granular material may have some extent of fluidity. The term "transferring the granular material" as used herein is intended to represent moving (or transferring) the granular material 31*a*~31*b* so that the granular material may move from the departing location to the destination. The term "accumulative height of the granular material" as used herein is intended to represent the vertical thickness of a mass of granular material 31*a*~31*b* accumulated in the mattress at measuring position.

The term "transverse middle portion of the frame" as used herein is intended to represent generally a transverse portion of the frame 33*a*~33*b* for supporting the user on it. In the ordinary mattress, the user is supported in a middle portion of the frame. Only this case, the term "transverse middle portion of the frame" is intended to represent a portion located at the transverse center of the frame 33*a*~33*b* and having a transverse dimension of from 10% to 50%, preferably 20% to 40%, of the transverse dimension 59 of the frame 33*a*~33*b*. The term "transverse side portion of the frame" as used herein is intended to represent either of the rest portions of "transverse middle portion of the frame".

Small Partial Oppression

Figure 6:
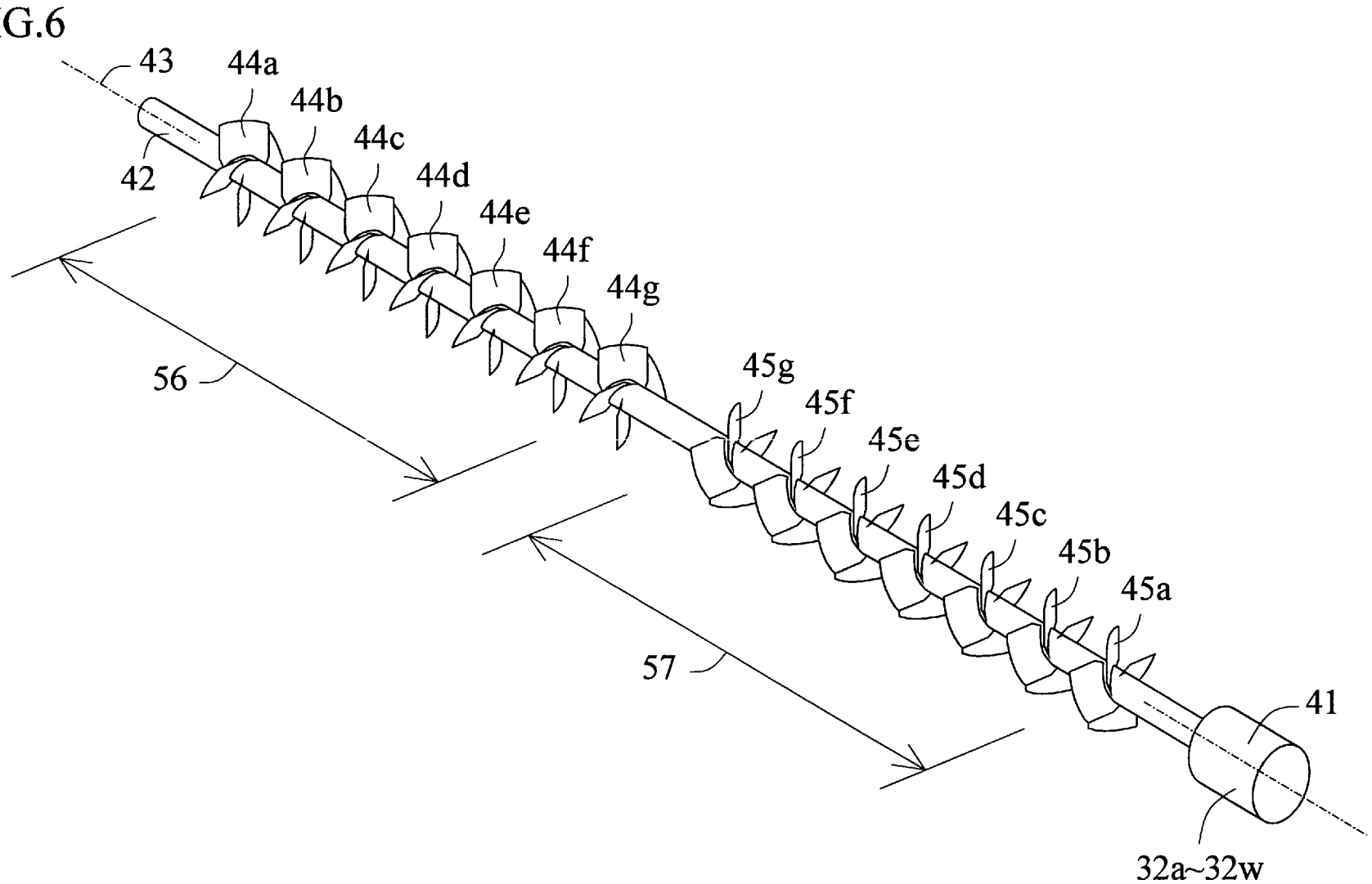
FIG. 6 is a perspective view of rotary blade device.
Figure 8A:
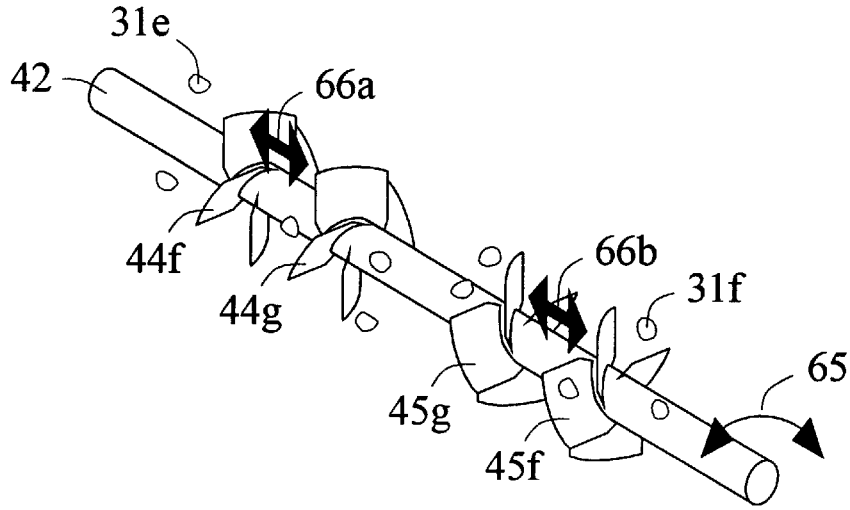
FIGS. 8A, 8B and 8C are partial perspective views of rotary blade device operating on granular material.

In order to reduce the partial oppression, as illustrated in FIGS. 6 and 8A, the semi-fluid mattress of this embodiment operates the rotary blade devices 32*a*~32*w* in a fluidizing mode as called herein so that the impeller members 44*a*~44*g* and 45*a*~45*g* may rotate alternately clockwise and counterclockwise as shown in an arrow 65. The granular material 31*e*~31*f* around the impeller members 44*a*~44*g* and 45*a*~45*g* is shaken (or stirred) as shown schematically in arrows 66*a* and 66*b*, and this granular material 31*e*~31*f* gets local fluidity depending on the output power of the driving motor 41.

Figure 9A:
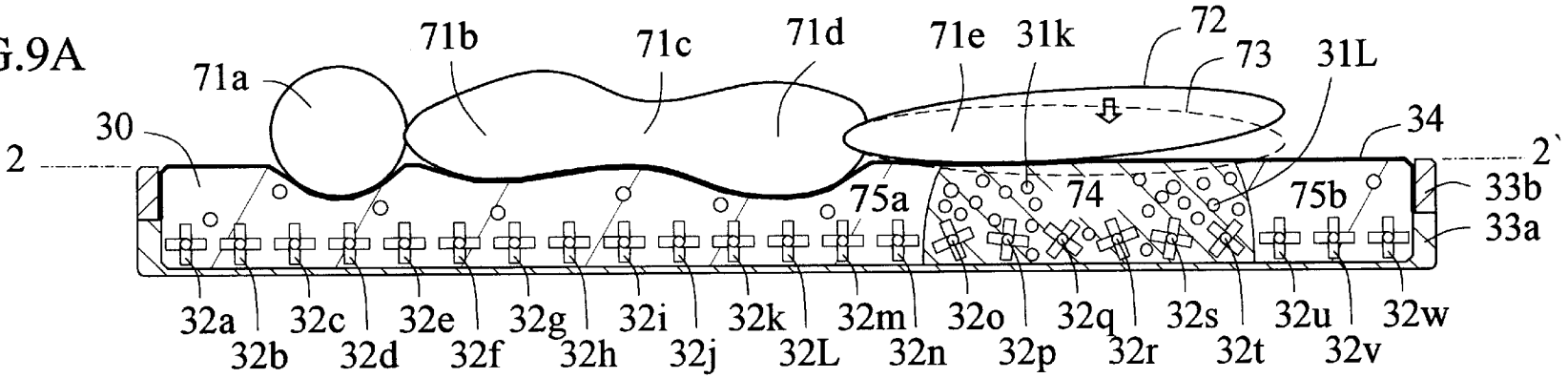
FIGS. 9A and 9B are vertical sectional views taken on line 2-2' of FIG. 1, schematically illustrating the condition of supporting the user.

As illustrated in FIG. 9A, if the user (head 71*a*, shoulder 71*b*, waist 71*c*, hip 71*d*, and leg 71*e*) feels a partial oppression at the leg region 71*e* in the current supporting condition 72, he operates a part of the rotary blade devices 32*o*~32*t* corresponding to the leg region 71*e* in the fluidizing mode. The driven granular material 31*k*~31L in the area 74 around the rotary blade devices 32*o*~32*t* flows (or drifts) locally in the semi-fluid mattress like a fluid, and the shape of the mattress contacting with the body changes to a new shape with small partial oppression at that area 74, owing to the characteristics of the fluid. Thus the user obtains a new supporting condition 73 with small partial oppression at the leg region 71*e*.

Within a period of the above operation, the granular material still remains in a stationary state at the surrounding area 75*a* and 75*b* where the rotary blade devices 32*a*~32*n* and 32*u*~32*w* are stationary or stopped. Since, in the stationary state, a mass of granular material can support the load steadily in the shape which would be given before, the other regions 71*a*~71*d* of the body continue to be supported steadily on the granular material while the above operation is continuing.

When the user gains a feeling of satisfaction with the partial oppression, he stops all of the rotary blade devices 32*a*~32*w*. The semi-fluid mattress thereafter supports the user steadily in the shape given till then.

Accordingly, the semi-fluid mattress of this embodiment can continue to support the body steadily with small partial oppression, if the shape of the mattress is such a shape with small partial oppression obtained in the above operation.

Fitness for Natural Posture

Figure 8B:
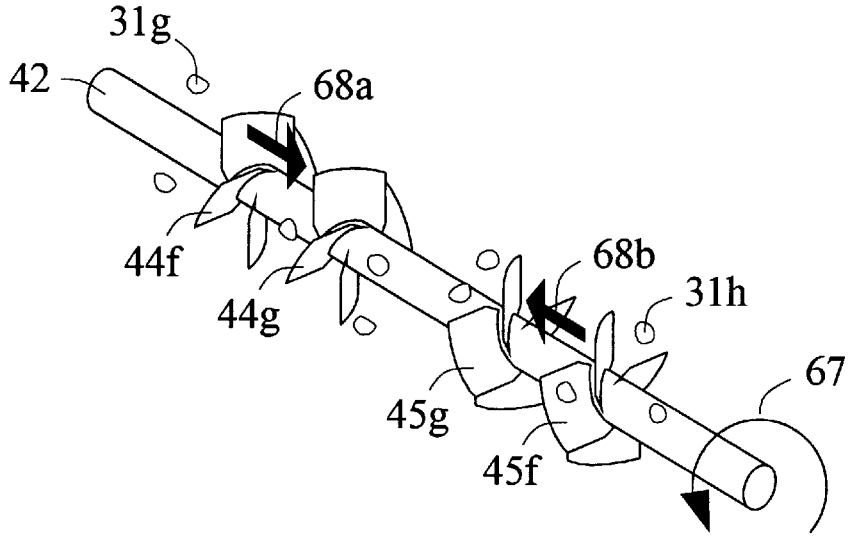
Figure 8C:
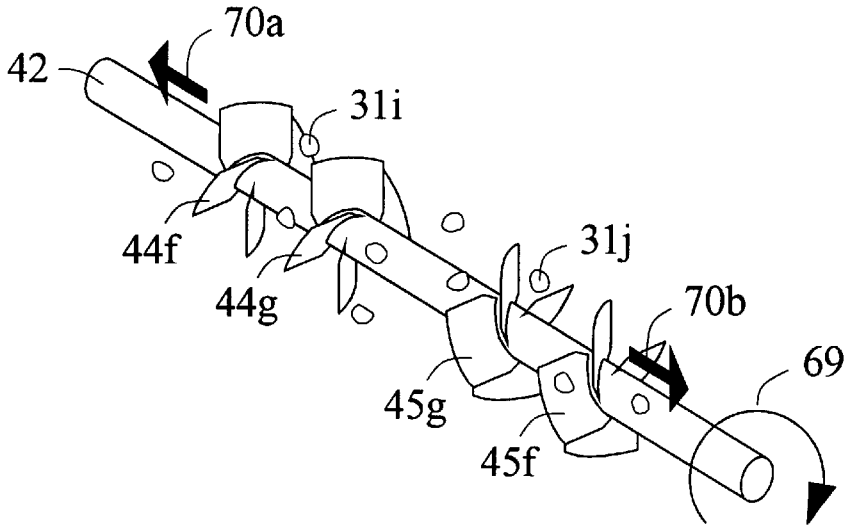

In order to obtain fitness for natural posture, as illustrated in FIGS. 6, 8B and 8C, the semi-fluid mattress of this embodiment operates the rotary blade devices 32*a*~32*w* in a transferring mode as called herein so that the impeller members 44*a*~44*g* and 45*a*~45*g* may rotate in certain direction as shown by arrow 67 or 69.

Because of the difference of specific gravity in regions of the body, the user tends to have unnatural posture when lying on a fluid or fluidized bed. To compensate for deterioration of the posture, it is important to adjust a supporting height 52 for each region 51 of the body, as illustrated in FIG. 5. In the semi-fluid mattress of this embodiment, the above adjustment of the supporting height 52 is achieved by transferring (or moving) the granular material 31*a* between a transverse middle portion 54 and transverse side portions 55*a* and 55*b* of the frame 33*a*~33*b*.

As illustrated in FIGS. 5, 6 and 8C, since each of the rotary blade devices 32*a*~32*w* has the left-handed impeller members 44*a*~44*g* within the left zone 56 and the right-handed impeller members 45*a*~45*g* within the right zone 57 on the shaft member 42, the granular material 31*i*~31*j* around the impeller members 44*a*~44*g* and 45*a*~45*g* is transferred from the transverse middle portion 54 to the transverse side portions 55*a* and 55*b* of the frame 33*a*~33*b* as shown schematically in arrows 70*a* and 70*b*, when the impeller members 44*a*~44*g* and 45*a*~45*g* rotate clockwise viewing from the driving motor 41 as shown in arrow 69.

Also, as illustrated in FIGS. 6 and 8B, when the impeller members 44*a*~44*g* and 45*a*~45*g* rotate counterclockwise viewing from the driving motor 41 as shown in arrow 67, the granular material 31*g*~31*h* around the impeller members 44*a*~44*g* and 45*a*~45*g* is transferred from the transverse side portions 55*a* and 55*b* to the transverse middle portion 54 of the frame 33*a*~33*b* as shown schematically by arrows 68*a* and 68*b*.

The above transferring of the granular material makes it possible to adjust the distribution of an accumulative height 53 of the granular material in the transverse middle portion 54 of the frame 33*a*~33*b*. Since the transverse middle portion 54 of the frame 33*a*~33*b* usually corresponds to the area for supporting the user, the above adjustment corresponds to an adjustment of the supporting height 52 in each region 51 of the body.

Figure 9B:
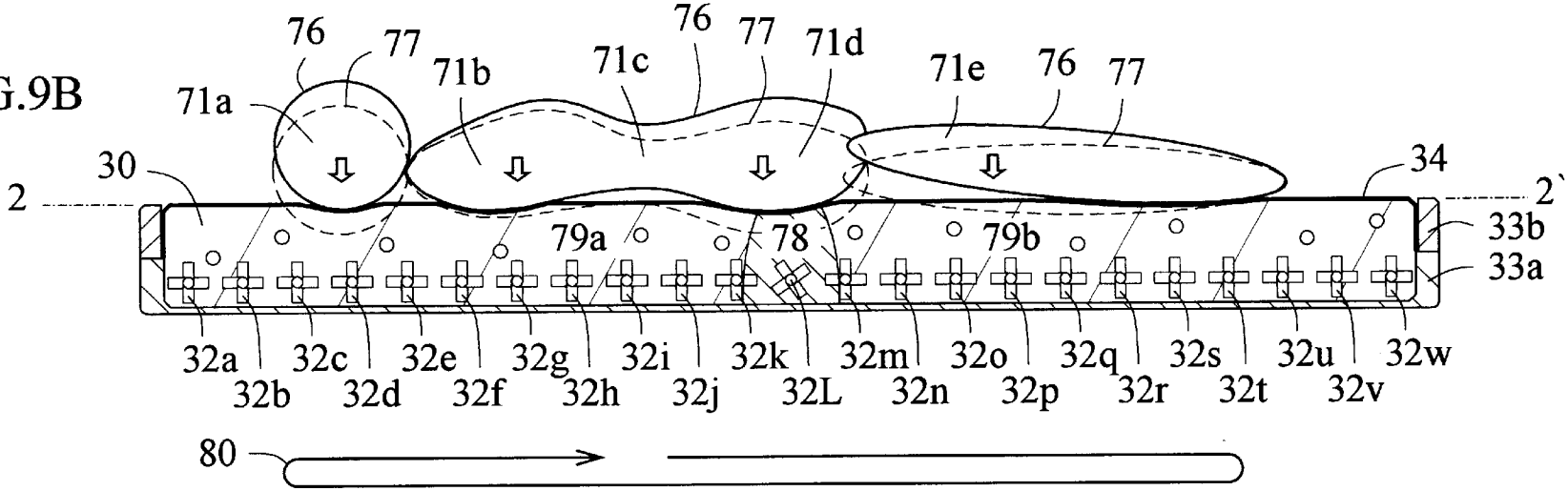
Figure 10A:
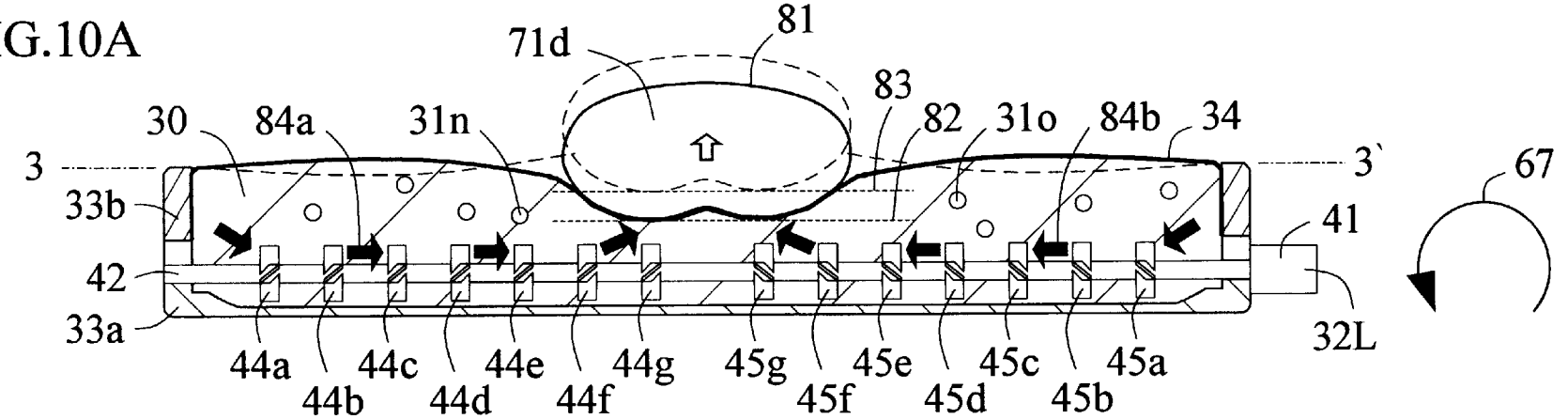
FIGS. 10A and 10B are vertical sectional views taken on line 3-3' of FIG. 1, schematically illustrating the condition of supporting the user.
Figure 10B:
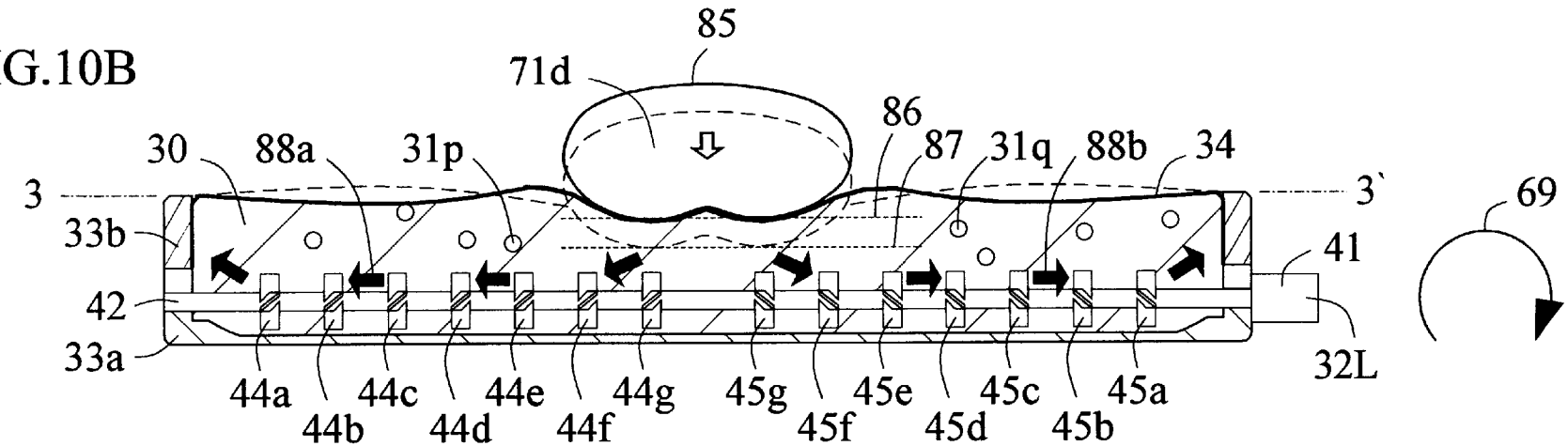

As illustrated in FIGS. 10A, 10B and 9B, if the user feels something wrong with the supporting height of a hip region 71*d* in the current posture 81 or 85, he operates a part of the rotary blade devices 32*a*~32*w* corresponding to the hip region 71*d* in the transferring mode.

FIG. 10A illustrates a case of lifting up the hip region 71*d* from the current supporting height 82 to new supporting height 83 by transferring the granular material 31*n*~31*o* from the transverse side portions 55*a* and 55*b* to the transverse middle portion 54 of the frame 33*a*~33*b*, as shown schematically in arrows 84*a* and 84*b*, by rotating the impeller members 44*a*~44*g* and 45*a*~45*g* of the rotary blade device 32L counterclockwise as shown in an arrow 67.

Also FIG. 10B illustrates a case of sinking down or lowering the hip region 71*d* from the current supporting height 86 to new supporting height 87 by transferring the granular material 31*p*~31*q* from the transverse middle portion 54 to the transverse side portions 55*a* and 55*b* of the frame 33*a*~33*b*, as shown schematically in arrows 88*a* and 88*b*, by rotating the impeller members 44*a*~44*g* and 45*a*~45*g* of the rotary blade device 32L clockwise as shown in an arrow 69.

Accordingly, by applying the above operation to each region of the body, the semi-fluid mattress of this embodiment obtains the fitness for natural posture.

Light Semi-fluid

To reduce the weight of the semi-fluid mattress, it is appropriate to use light granular material. In the case of using light granular material, the user tends to sink in the semi-fluid mattress when the granular material is fluidized widely, because the buoyancy operating on the body is small. This phenomenon is common to the case of lifting up or sinking down the region of the body in a direction conflicting with buoyancy of the fluidized granular material.

A scanning control method of the semi-fluid mattress of this embodiment restricts fluidized area of the granular material in narrow at a time, and prepares wide stationary area of the granular material before and behind the narrow fluidized area. And it scans the narrow fluidized area along the body, supporting the user steadily on the wide stationary area.

As illustrated in FIG. 9B, if the user feels a partial oppression at whole regions 71*a*~71*e* in the current supporting condition 76, he needs to operate many rotary blade devices 32*c*~32*t*, in the fluidizing mode, corresponding to whole regions 71*a*~71*e*. In this case, if all of the above rotary blade devices 32*c*~32*t* are operated at a time, it is inevitable to suffer hard deterioration of the posture caused by the sinking of whole body into the light granular material.

Accordingly, the user operates the required rotary blade devices 32*c*~32*t* one by one as shown in an arrow 80. At the narrow fluidized area 78 of the granular material corresponding to the rotary blade device 32L which is operated currently, the granular material flows in the mattress, and the shape of the mattress changes to a new shape with small partial oppression. Also, at the wide stationary area 79*a* and 79*b* of the granular material corresponding to the rotary blade devices 32*a*~32*k* and 32*m*~32*w* which are paused currently, the other regions of the body are supported steadily. Scanning the narrow fluidized area 78 along all of the regions, the user gains small partial oppression on the whole body at new supporting condition 77 without suffering hard deterioration of the posture.

By applying the scanning control method for the operation of the rotary blade devices 32*a*~32*w* in the fluidizing mode and in the transferring mode, the semi-fluid mattress of this embodiment provides the user totally desirable effect on whole regions preventing the body from over sinking, even if a light granular material is used.

Mixture of Operation

In the above description, the operation for obtaining small partial oppression and the operation for obtaining the fitness for natural posture are explained individually. But it is important to simultaneously apply these operations to obtain small partial oppression and the fitness for natural posture well balanced. Preferably, these operations should be applied to each region of the body jointly, repeatedly, and little by little, using together an unbalanced rotation of the rotary blade devices 32*a*~32*w*, for example, such as turning twice clockwise after turning once counterclockwise. Thus the user obtains small partial oppression and the fitness for natural posture.

In the case of using a light granular material, preferably, the rotary blade devices should be rotated intermittently (or with periodical pulsed driving), especially when transferring the granular material. By the intermittent rotation of the rotary blade devices, the shortage of buoyancy is compensated to some extent due to the inertia of the body and the granular material.

Installation to Bed

The semi-fluid mattress of this embodiment can be installed in a bed as a semi-fluid user supporting system separable or inseparable from the bed.

Figure 11:
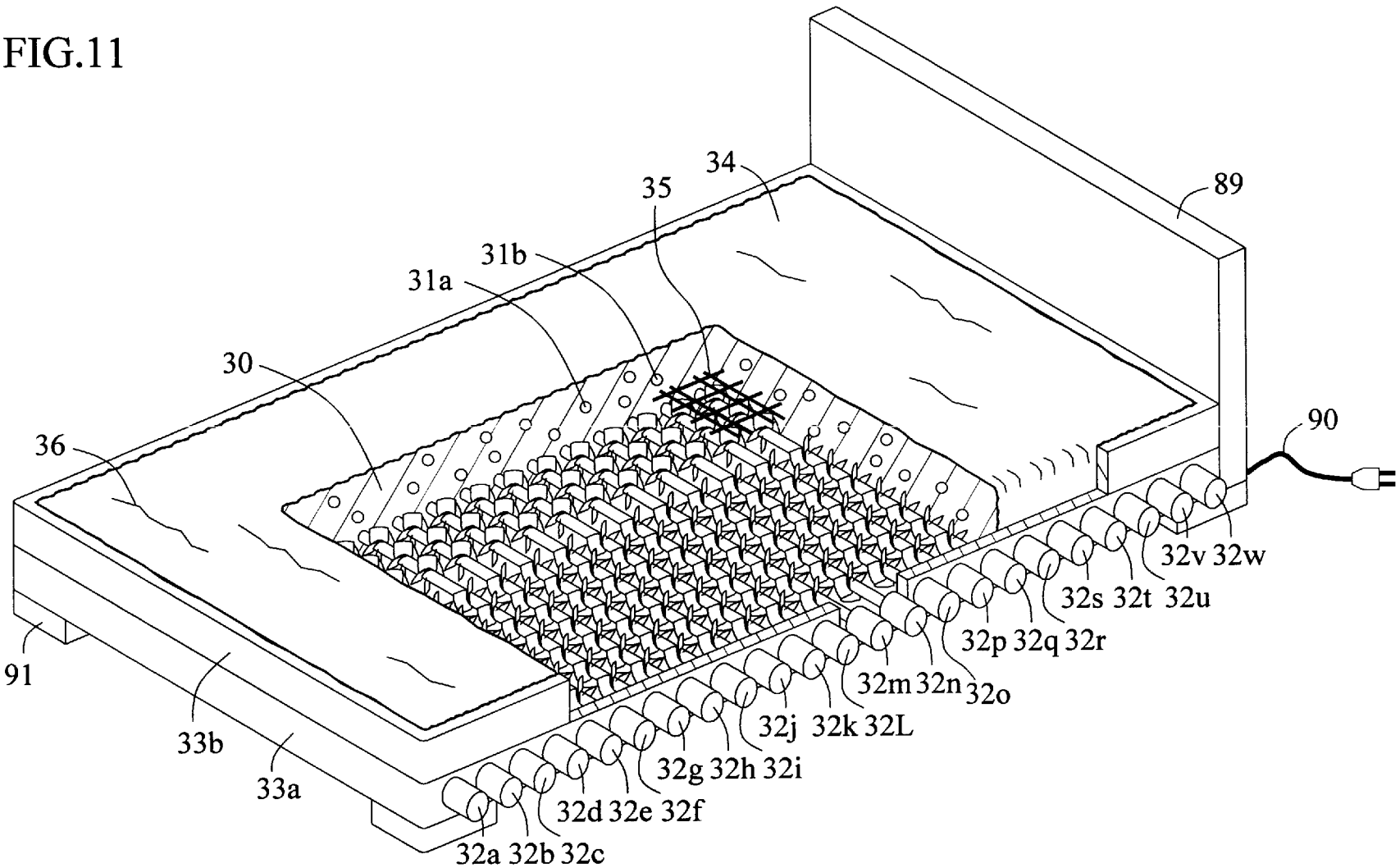
FIG. 11 is a partial cutaway perspective view of an example of the semi-fluid mattress of this invention installed in a bed.
Figure 12:
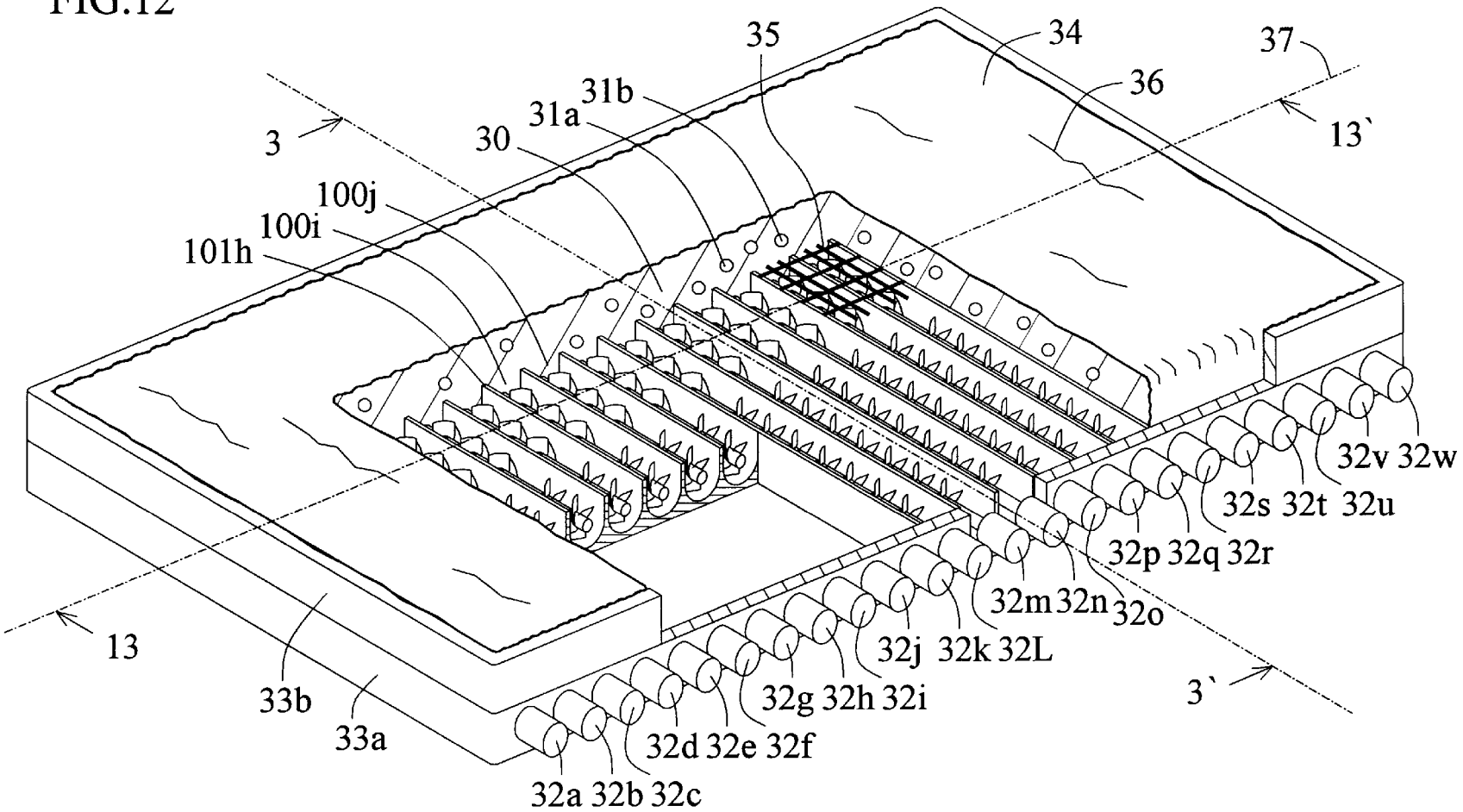
FIG. 12 is a partial cutaway perspective view of the other preferred embodiment of the semi-fluid mattress of this invention.

FIG. 11 illustrates a semi-fluid bed composed of the semi-fluid mattress of this embodiment, a power control unit 89, a power line 90, and legs 91. The power control unit 89 is connected to the power line 90 and drives the rotary blade devices 32*a*~32*w* under the indication of some remote-control apparatus of the user. Since the power control unit 89 is usually composed of an electronic circuit and heat sinks, the semi-fluid mattress of this embodiment can have it built-in by installing the heat sinks, for example, in a lower surface of the floor 39 of the frame 33*a*~33*b*.

Preferably, the semi-fluid mattress should be separable from the semi-fluid bed. But also, the semi-fluid mattress of this embodiment can be installed in the semi-fluid bed as an inseparable component to support the user thereon, if necessary.

The Other Embodiment

FIGS. 12~23 illustrate the other preferred embodiments of a semi-fluid mattress of this invention and the other examples of the components of the semi-fluid mattress.

Channel Structure

FIGS. 12~15 illustrate the second preferred embodiment of a semi-fluid mattress of this invention. This embodiment further comprises channels (or channel structures) 100*a*~100*w* in addition to the first preferred embodiment, to localize the functioning area of the rotary blade devices 32*a*~32*w* and to strengthen the machinery.

Figure 13:
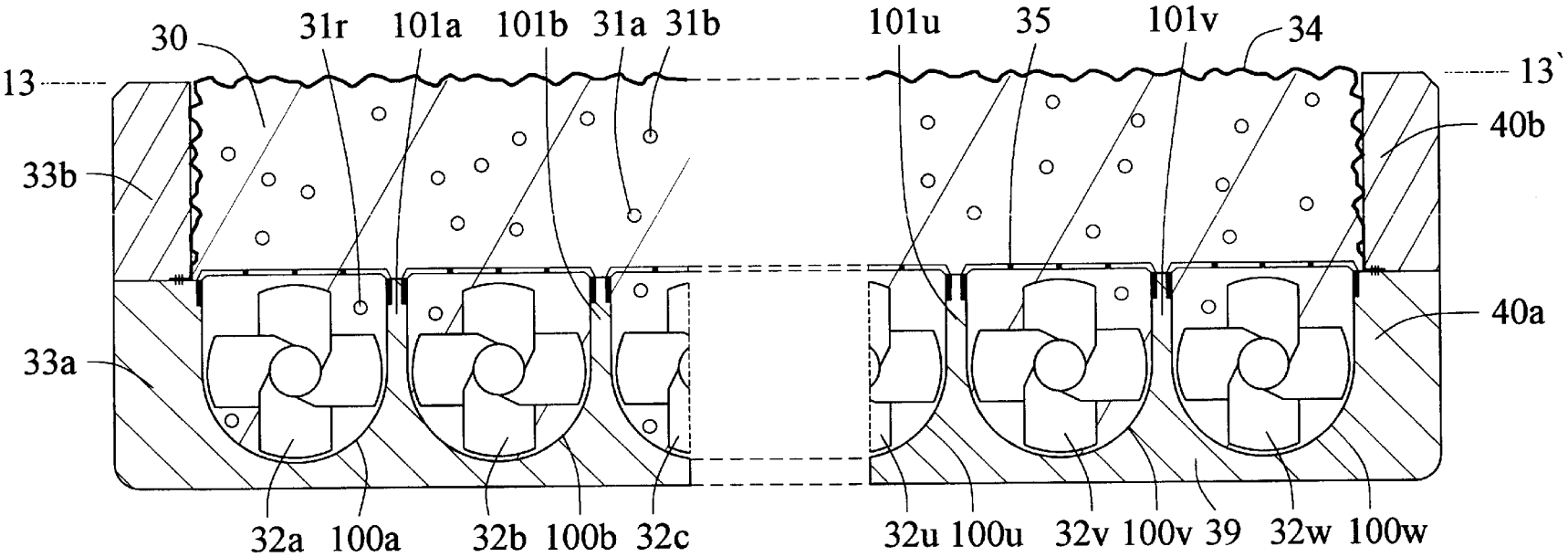
FIG. 13 is a partial vertical sectional view taken on line 13-13' of FIG. 12.

As illustrated in FIGS. 12, 13, 14A, 14C and 3, the floor 39 has channels 100*a*~100*w* on the upper side of the floor 39 of the frame 33*a*~33*b*. Each channel 100*a* houses the corresponding rotary blade device 32*a* at least partially. Preferably, the vertical depth of the channel 100*a* should be equal to or greater than an outer or external radius of rotation 103R, as shown in a circle 103, of the impeller members 44*a*~44*g* and 45*a*~45*g*. Accordingly, each direction of the channel 100*a* has an angle of from 60 to 120 degrees relative to a longitudinal axis 37 of the frame 33*a*~33*b*, and the shaft member 42 of each rotary blade device 32*a* is rotatable on a rotatory axis 43 substantially parallel to the corresponding channel 100*a*. As illustrated in FIG. 13, since the wall 101*a* of the channel 100*a* controls the longitudinal moving of the granular material 31*r* toward the next channel 100*b*, the functioning area of each of the rotary blade devices 32*a*~32*w* is localized so that the independent controllability in each region of the body may be improved.

Figure 14A:
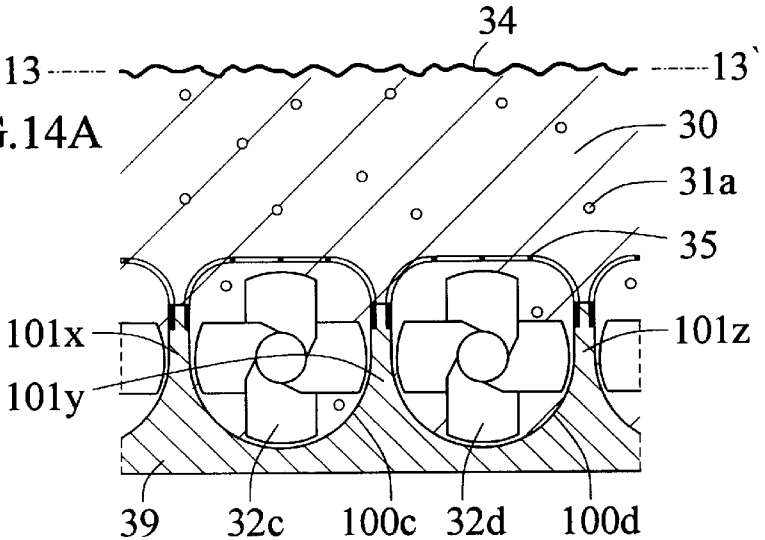
FIGS. 14A, 14B and 14C are partial vertical sectional views taken on line 13-13' of FIG. 12, illustrating channels and rotary blade devices.
Figure 14B:
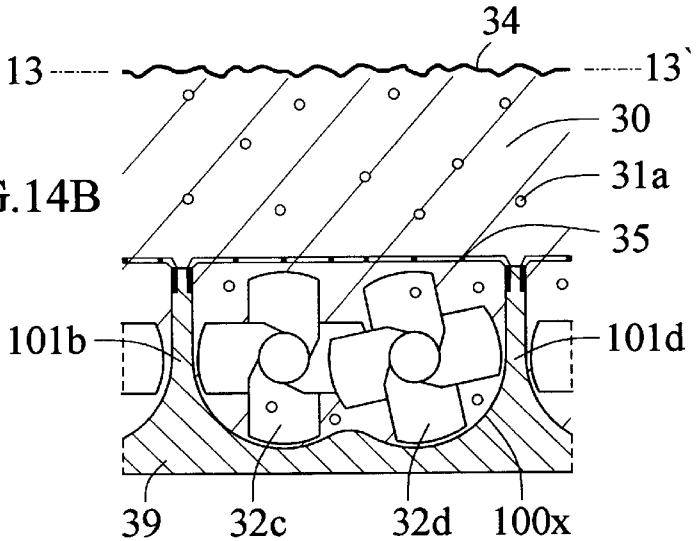

As illustrated in FIGS. 14A and 13, the height of the walls 101*a*~101*v* and 101*x*~101*z* of the channels can vary depending on the characteristics of the granular material and on each region of the body. As illustrated in FIG. 14B, two or more rotary blade devices 32*c*~32*d* can be placed in the same channel 100*x*. The functioning areas of the adjoining rotary blade devices 32*c* and 32*d* can overlap each other by shifting mounting positions of the impeller members. As illustrated in FIG. 14A, the safety net member 35 is connected to the upper side of the walls 101*y* and 101*z* of the channel 100*d* to share the load on the safety net member 35.

Figure 14C:
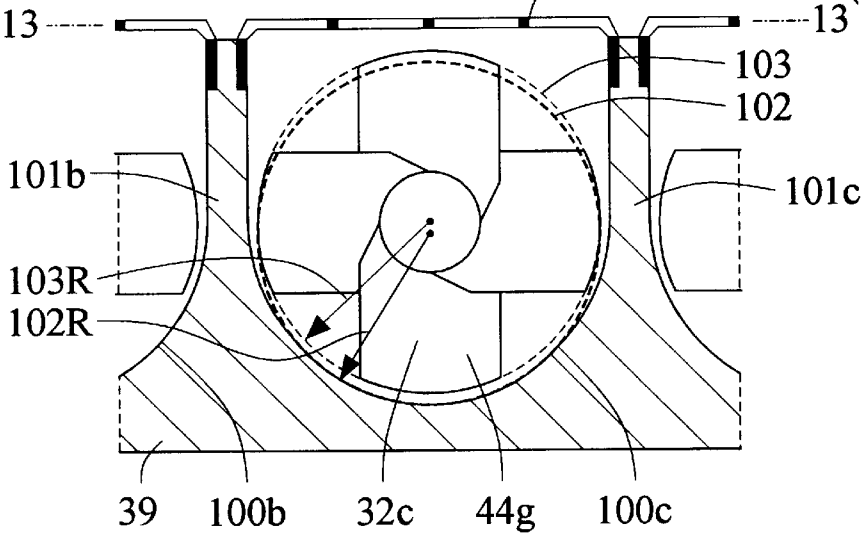

As illustrated in FIGS. 14C and 3, in order to support the rotary blade device 32*c* when the shaft member 42 curved by the lateral load, preferably, the inner surface of the channel 100*c* should share the lateral load like a bearing for the impeller member 44*g*. Therefore the radius of curvature 102R, as shown in a circle 102, of the inner surface of the channel 100*c* is substantially equal to an outer or external radius of rotation 103R of the impeller members 44*a*~44*g* and 45*a*~45*g* on the rotatory axis 43. Normally, the rotary blade device 32*c* is apart from a inner surface of the channel 100*c*. They contact when the shaft member 42 is curved, and the inner surface of the channel 100*c* supports the rotary blade device 32*c*. It is desirable to use ordinary bearings for the extra support of the shaft member 42, obviously. Also, the direction of the channel can be curved. In the curved channel, divided shaft members, flexible joint, and extra bearings are available for the rotary blade device.

Figure 15:
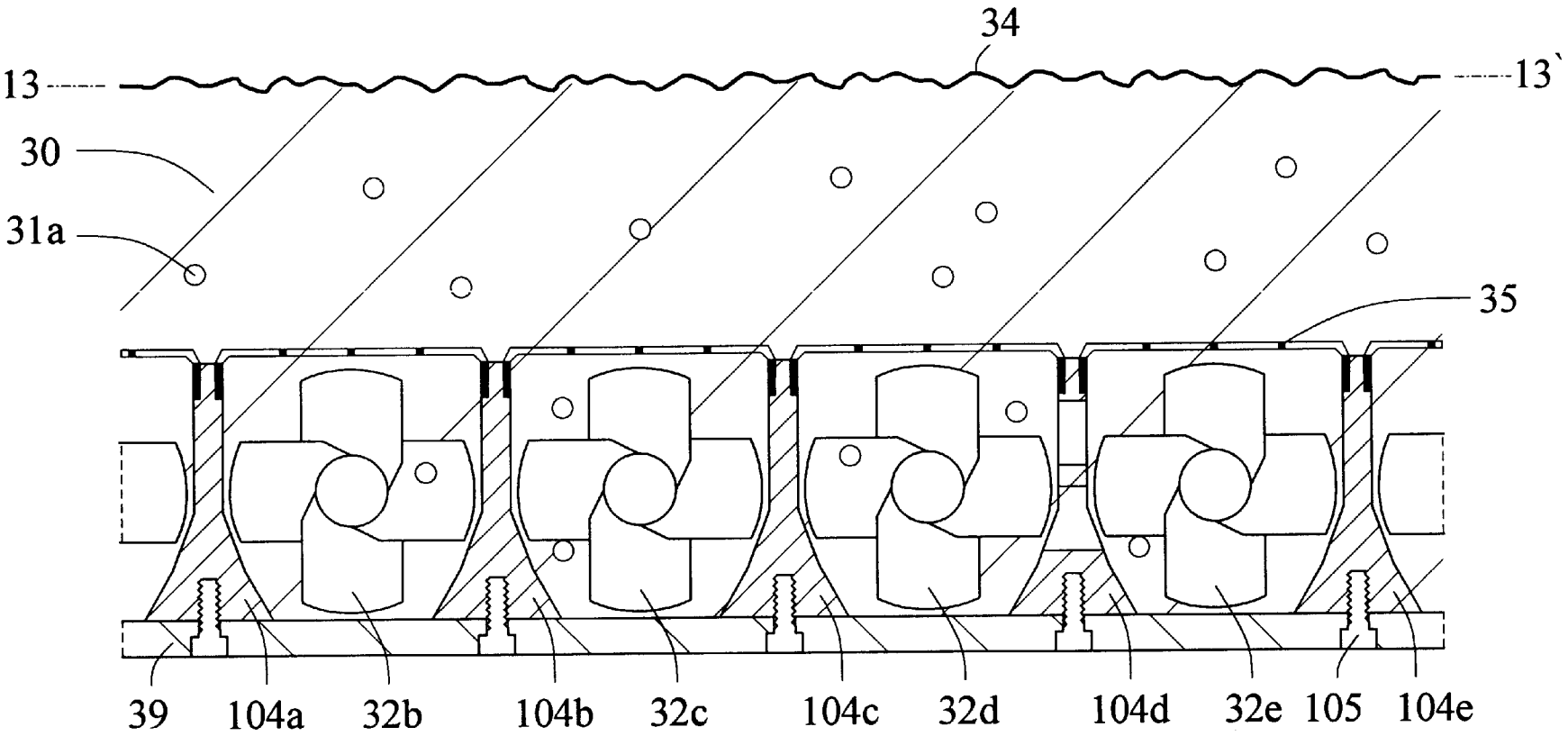
FIG. 15 is a partial vertical sectional view similar to FIG. 13, illustrating partitions instead of channels.

As illustrated in FIGS. 15, 13 and 14C, partitions 104*a*~104*e* supported in the frame 33*a*~33*b* can be used instead of the channels 100*a*~100*e*. The partitions 104*a*~104*e* are fixed to the floor 39 by bolts 105. The partition 104*c* is located between adjoining rotary blade devices 32*c* and 32*d*. The partition 104*d* can have holes, if necessary. Preferably, vertical height of the partition 104*a* should be equal to or greater than an outer radius of rotation 103R of the impeller members 44*a*~44*g* and 45*a*~45*g*. The vertical height of the partition 104*d* as used herein is defined as a height of the top of the partition 104*d* measured from the surface of floor 39 regardless the space between the partition and the floor 39. The partition 104*b* functions like the wall 101*b* of the channel 100*b*. Accordingly, each direction of the partition 104*a* has an angle of from 60 to 120 degrees relative to a longitudinal axis 37 of the frame 33*a*~33*b*, and the shaft member 42 of each rotary blade device 32*b* is rotatable on a rotatory axis 43 substantially parallel to the corresponding partition 104*b*.

Cell Structure

Figure 16:
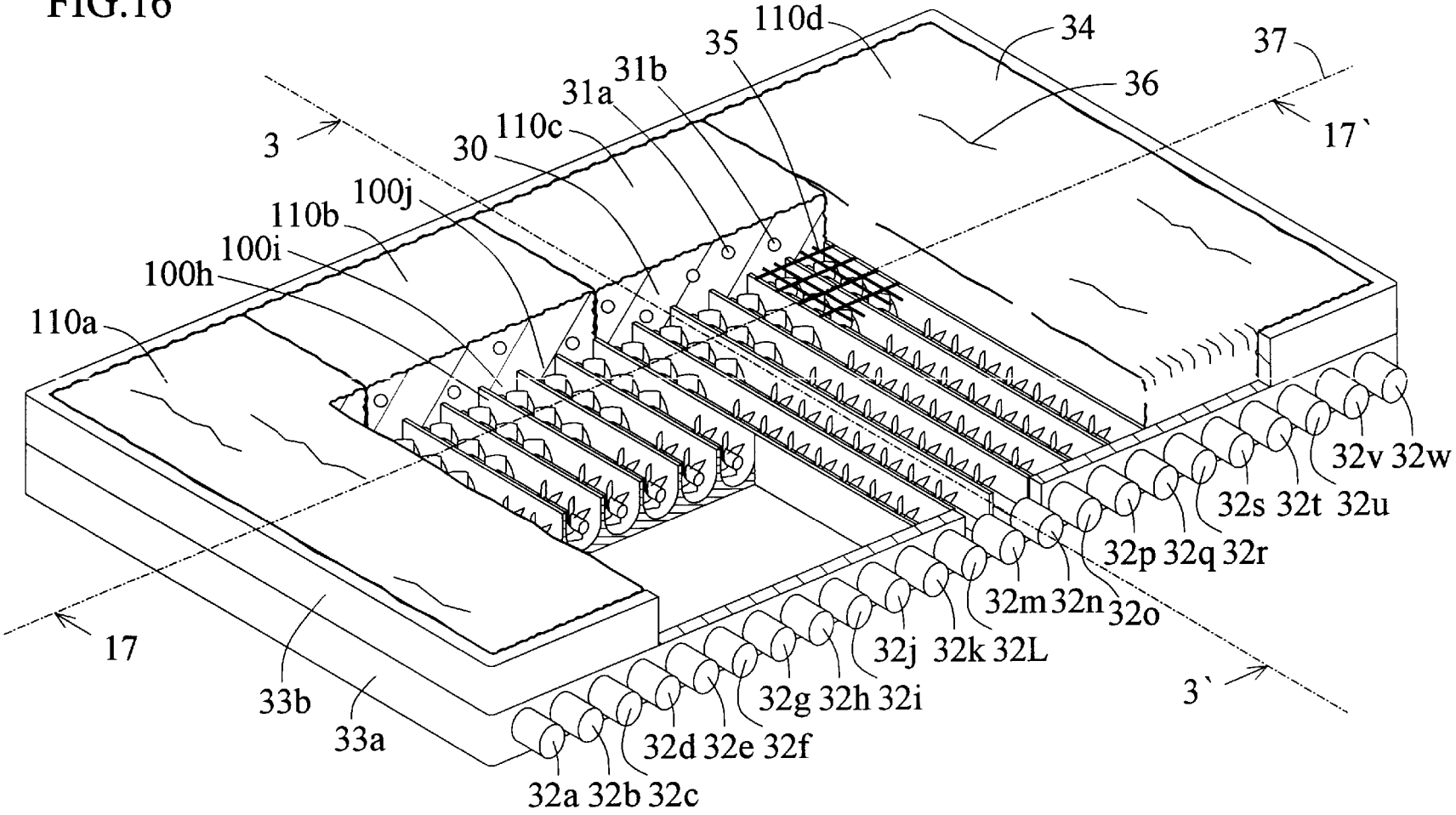
FIG. 16 is a partial cutaway perspective view of the other preferred embodiment of the semi-fluid mattress of this invention.
Figure 17A:
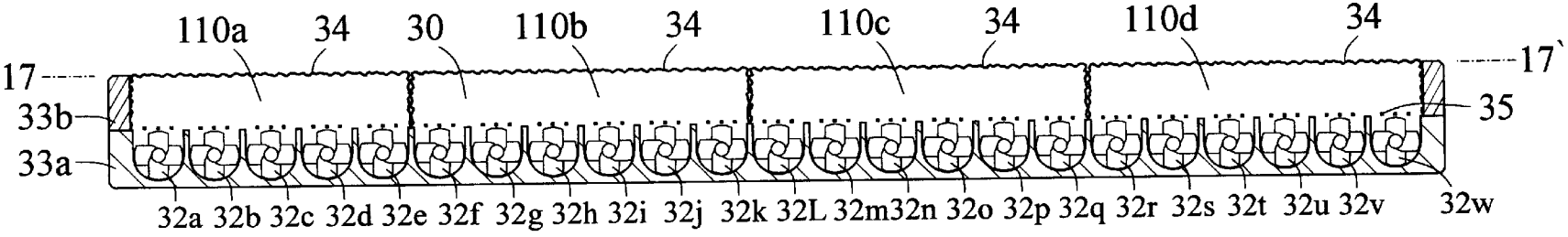
FIG. 17A is a schematic vertical sectional view taken on line 17-17' of FIG. 16.
Figure 17B:
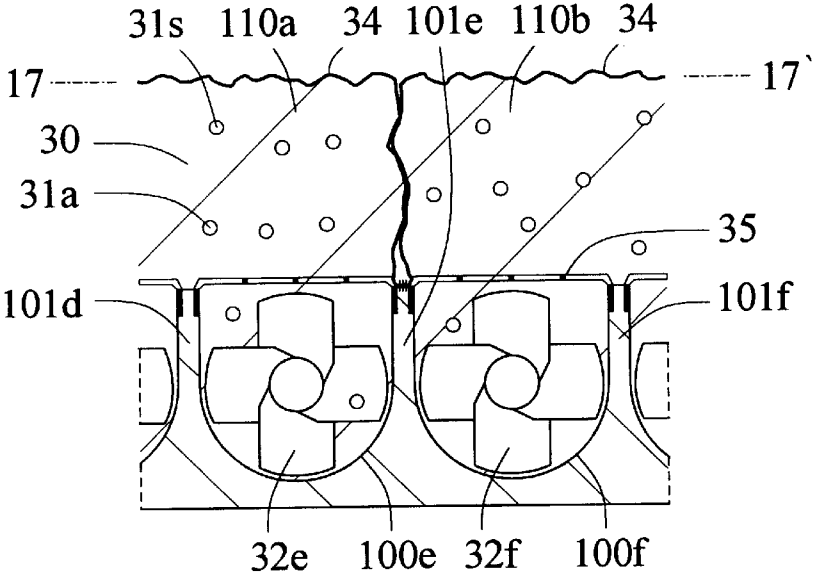
FIG. 17B is a partial vertical sectional view taken on line 17-17' of FIG. 16.
Figure 18:
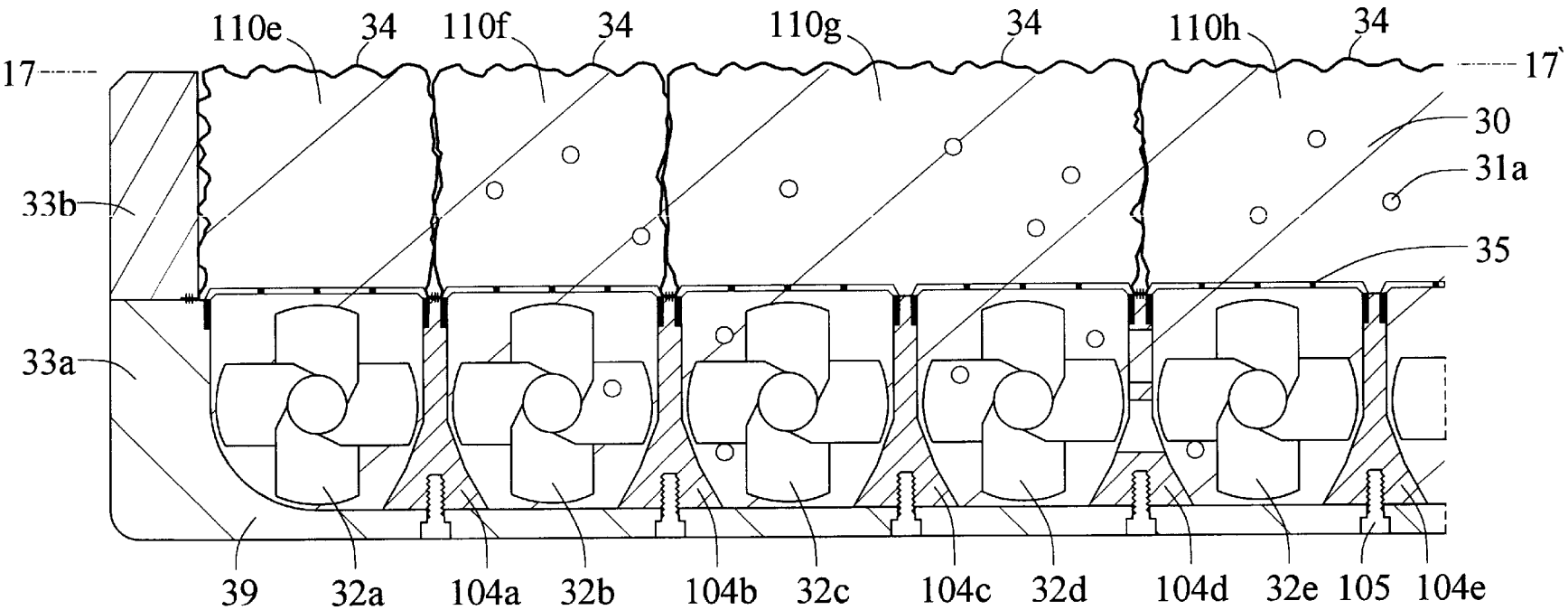
FIG. 18 is a partial vertical sectional view similar to FIG. 17B, illustrating partitions instead of channels.

FIGS. 16~18 illustrate the third preferred embodiment of a semi-fluid mattress of this invention. This embodiment comprises cells (or cell structures) 110*a*~110*d* in addition to the second preferred embodiment, to lessen a trouble for bed making and to improve the feel of the mattress.

As illustrated in FIGS. 16, 17A and 17B, each cell 110*a* is surrounded by the wall 101*e* of the channel 100*e*, the air permeable sheet 34 further connected to the wall 101*e* of the channel 100*e*, and the frame 33*a*~33*b*. Each of the cells 110*a*~110*d* holds a part of a mass of granular material. Since a longitudinal migration of the granular material 31*s* is restricted within the cell 110*a*, it lessens a trouble for bed making which is required in advance preparations or in turning of the body. The granular material can have different characteristics in each of the cells 110*a*~110*d* in improving the feel of the mattress. If ventilation through the granular material 31*a*~31*b* is not necessary, an air impermeable sheet can be used instead of the air permeable sheet 34.

As illustrated in FIGS. 18 and 13, the partition 104*b* can be used instead of the wall 101*b* the channel 100*b*. In this case, each cell 110*g* is surrounded by the partitions 104*b* and 104*d*, the air permeable sheet 34 farther connected to the partitions 104*b* and 104*d*, and the frame 33*a*~33*b*. In other word, the partitions 104*b* and 104*d*, the air permeable sheet 34 further connected to the partitions 104*b* and 104*d*, and the frame 33*a*~33*b* define a cell 110*g* surrounded therein. The cells 110*e*~110*h* hold a part of a mass of granular material severally. The cell 110*e* can include only one rotary blade device 32*a*. Also adjoining cells 10*g* and 110*h* can be connected through the halls of the partition 104*d*.

Single Ended Rotary Blade Device

Figure 19A:
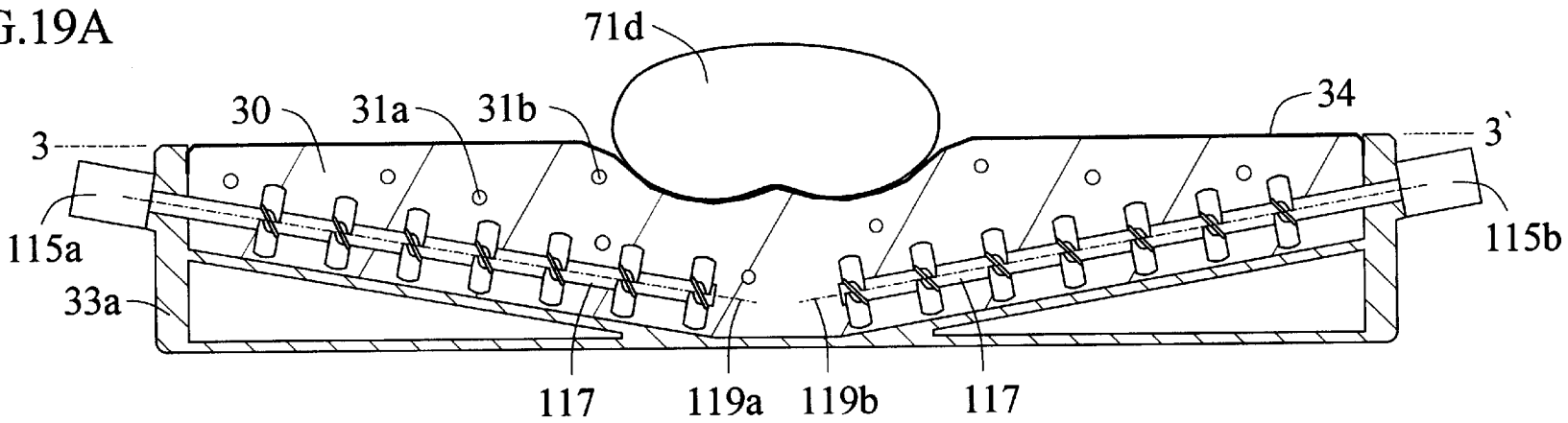
FIG. 19A is a schematic vertical sectional view, similar to FIG. 5, of the other preferred embodiment of the semi-fluid mattress of this invention.
Figure 19B:
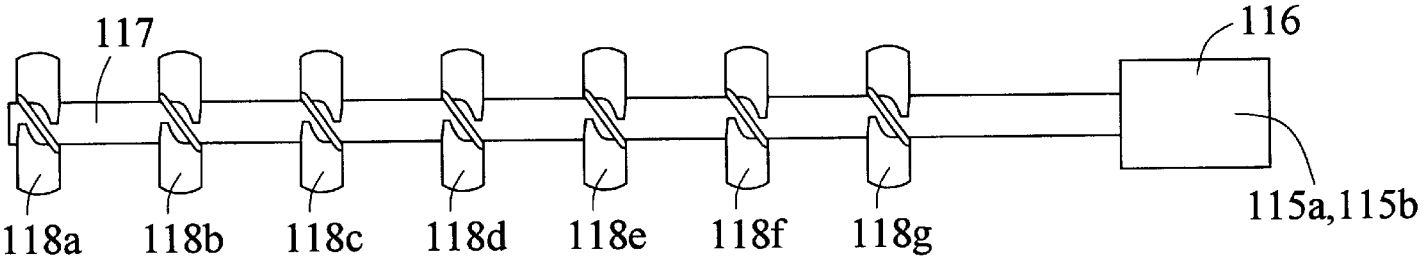
FIG. 19B is an elevational view of single-ended rotary blade device.

FIGS. 19A and 19B illustrate the fourth preferred embodiment of a semi-fluid mattress of this invention. This embodiment comprises single ended rotary blade devices 115*a*~115*b* instead of the rotary blade devices 32*a*~32*w* of the first preferred embodiment. Each of the single ended rotary blade devices 115*a*~115*b* has right-handed impeller members 118*a*~118*g* connected to a shaft member 117, and driven by a driving motor 116. The driving motor 116 is connected to the shaft member 117 to rotate the right-handed impeller members 118*a*~118*g* clockwise, counterclockwise, and alternately clockwise and counterclockwise. Operation of each of the single ended rotary blade devices 115*a*~115*b* is independently controlled, by the user, including the following operations: start, stop, rotating direction, and preferably rotating speed.

The single ended rotary blade devices 115*a*~115*b* are installed so that a rotatory axis 119*a*~119*b* of the shaft member 117 may have an angle of from 60 to 120 degrees relative to a longitudinal axis 37 of the frame 33*a*. The vertical direction and horizontal direction of the rotatory axis 119*a*~119*b* of the single ended rotary blade devices 115*a*~115*b* can vary. Preferably, the single ended rotary blade devices 115*a*~115*b* facing each other should be used in a pair.

The operations of the single ended rotary blade devices 115*a*~115*b* are similar to those of the rotary blade devices 32*a*~32*w* in the first preferred embodiment. For example, clockwise rotation of the rotary blade devices 32*a*~32*w* in the first preferred embodiment corresponds to the same clockwise rotation of the single ended rotary blade devices 115*a*~115*b*. Because the rotary blade devices 32*a*~32*w* in the first preferred embodiment have left-handed impeller members 44*a*~44*g* within the left zone 56 and right-handed impeller members 45*a*~45*g* within the right zone 57, and the single ended rotary blade devices 115*a*~115*b* has right-handed impeller members 118*a*~118*g* on its shaft member 117. The user can improve the handling of the semi-fluid mattress, by driving each of the single ended rotary blade devices 115*a*~115*b* independently.

A pair of the single ended rotary blade devices 115*a*~115*b* facing each other can be connected by such as a flexible joint and be driven by a common driving motor, if the screw directions of the impeller member of them are the opposite each other. Also, the rotary blade devices 32*a*~32*w* of the first preferred embodiment can be divided into more fine pieces, if necessary.

Blade and Guide

Figure 20A:
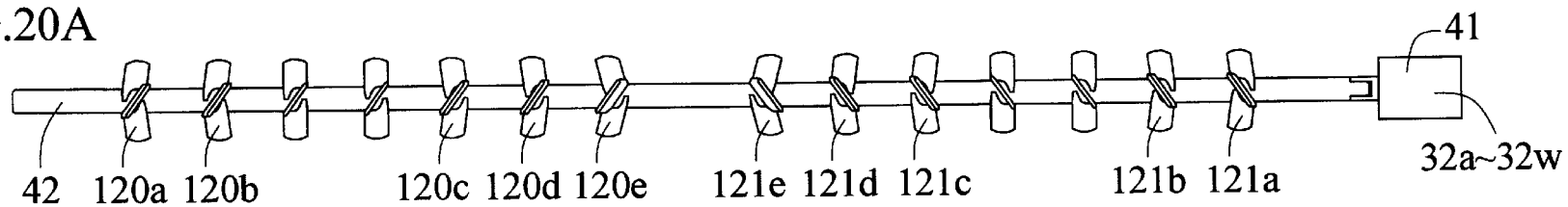
FIGS. 20A and 20B are elevational views of the other preferred embodiment of rotary blade device.
Figure 20B:
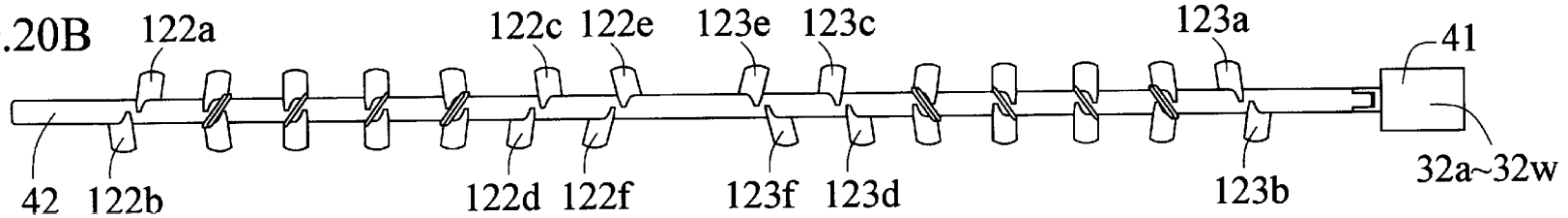
Figure 21:
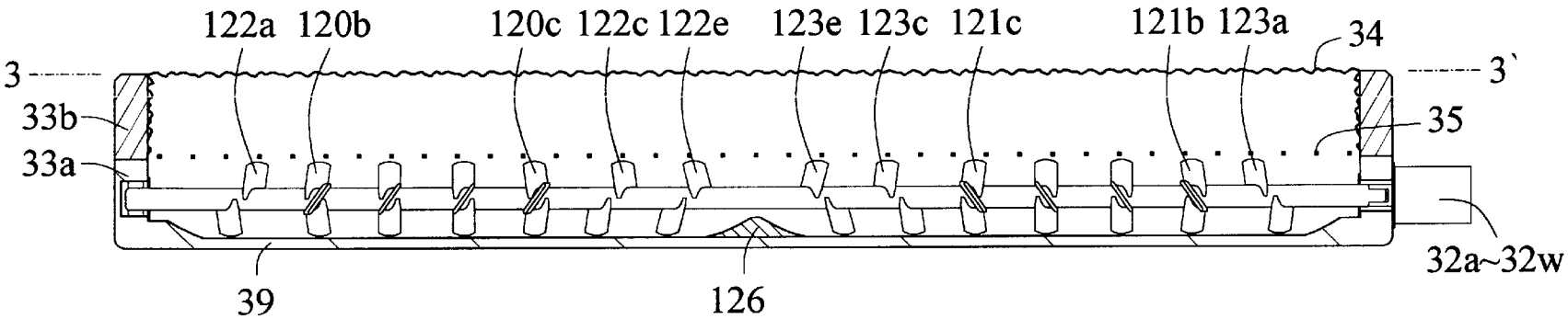
FIG. 21 is a schematic vertical sectional view similar to FIG. 5, illustrating a guide slope.

FIGS. 20A, 20B and 21 illustrate the other preferred embodiment of the blade member and the rotary blade devices of the semi-fluid mattress of this invention. Although the rotary blade devices 32*a*~32*w* are applied both for fluidizing and transferring the granular material 31*a*~31*b*, each blade member of the rotary blade devices 32*a*~32*w* can have biased feature suitable for either fluidizing or transferring the granular material 31*a*~31*b*. Accordingly, the shape, surface area, pitch, inclination, eccentricity, and linkage of the blade member can vary respectively.

Figure 20C:
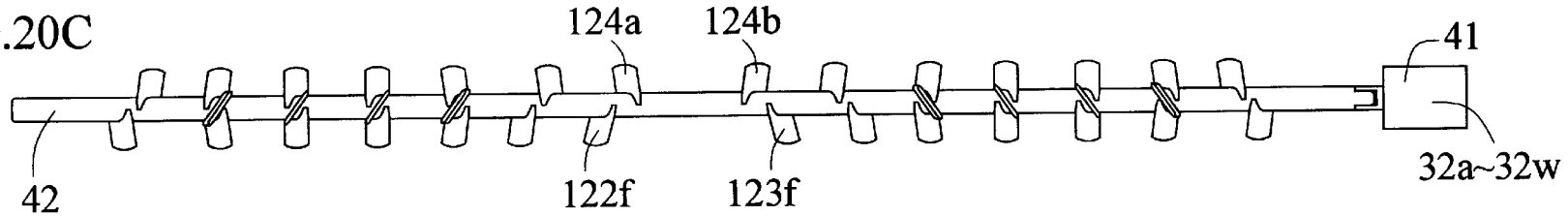
FIGS. 20C and 20D are elevational views of the other example of rotary blade device.

FIG. 20A illustrates rotary blade devices 32*a*~32*w* having left-handed inclined impeller members 120*a*~120*e* and right-handed inclined impeller members 121*a* 121*e* to increase the efficiency in fluidizing or transferring the granular material 31*a*~31*b*. FIG. 20B illustrates rotary blade devices 32*a*~32*w* having left-handed inclined and eccentric sole blade members 122*a*~122*f* and right-handed inclined and eccentric sole blade members 123*a*~123*f* to strengthen fluidizing of the granular material 31*a*~31*b*. FIG. 20C illustrates an example of the rotary blade devices 32*a*~32*w* having adjoining blade members 122*f* and 124*a*, or 123*f* and 124*b* with the opposite screw directions (or different pitch).

Figure 20D:
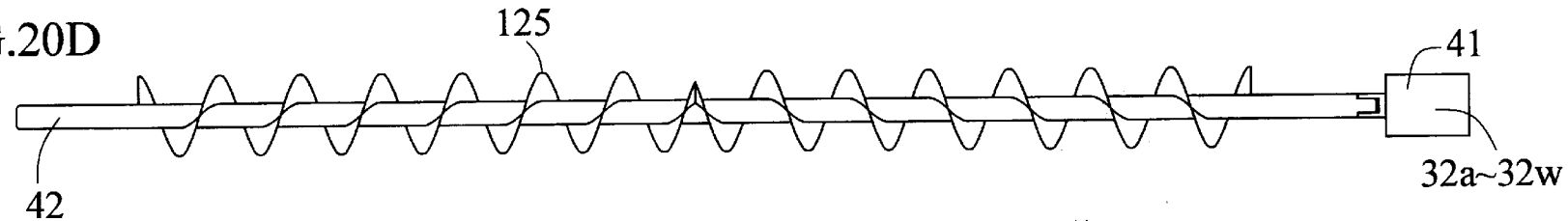

The particularly shaped blade member partially including the above-mentioned features is available, if necessary. An example of such particularly shaped blade member is a screw-like transferring blade partially having a kneading blade on it. FIG. 20D illustrates the rotary blade devices 32*a*~32*w* having a continuous screw blade member 125 as a simple example of the particularly shaped blade member.

As illustrated in FIG. 21, preferably, to assist the operation of the blade members, the guide slope 126 and guide vanes should be used in the transverse center of the frame 33*a*~33*b*.

Mirror Symmetrical Arrangement

Figure 22:
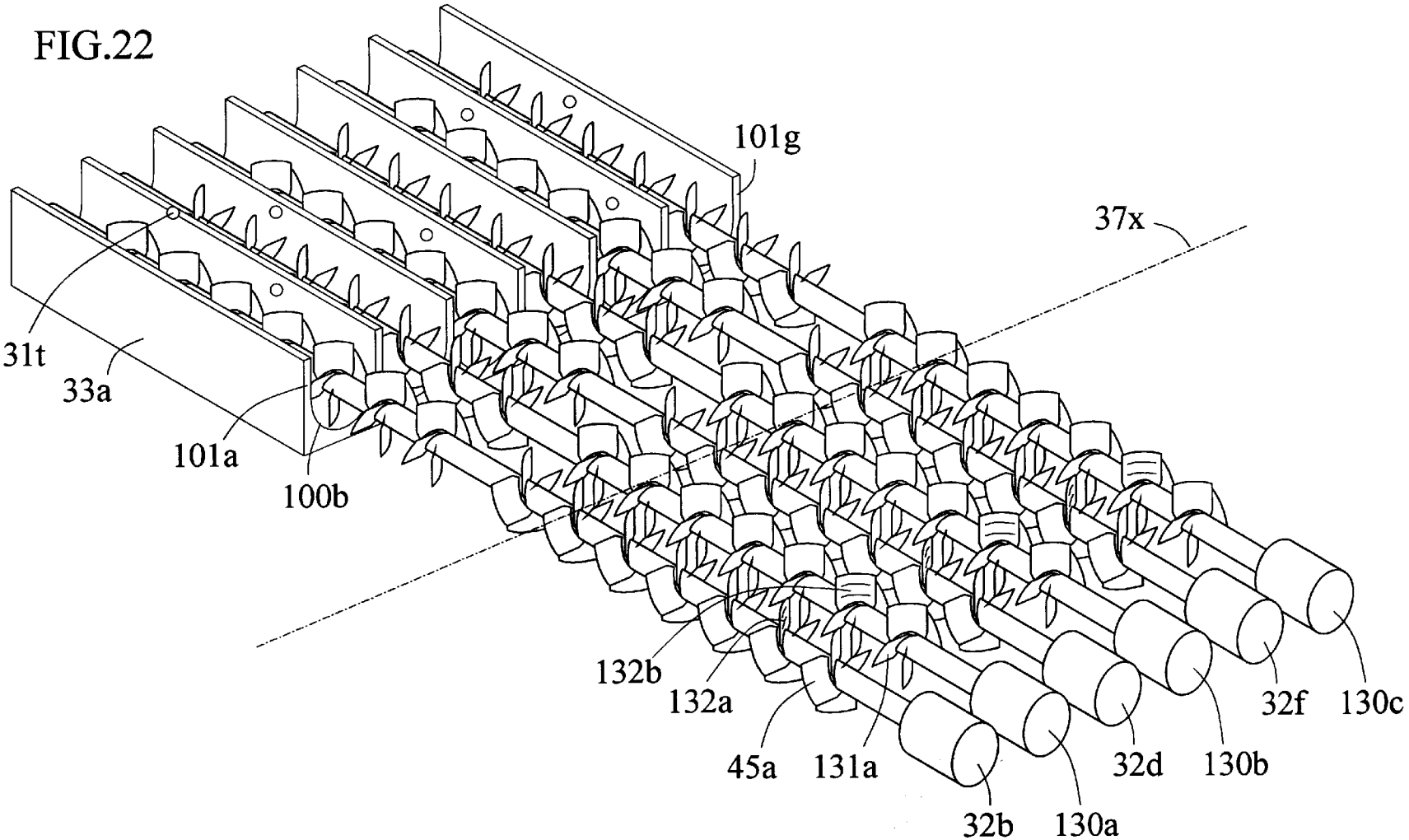
FIG. 22 is a perspective view of adjoining longitudinally mirror symmetrical rotary blade devices.
Figure 23A:
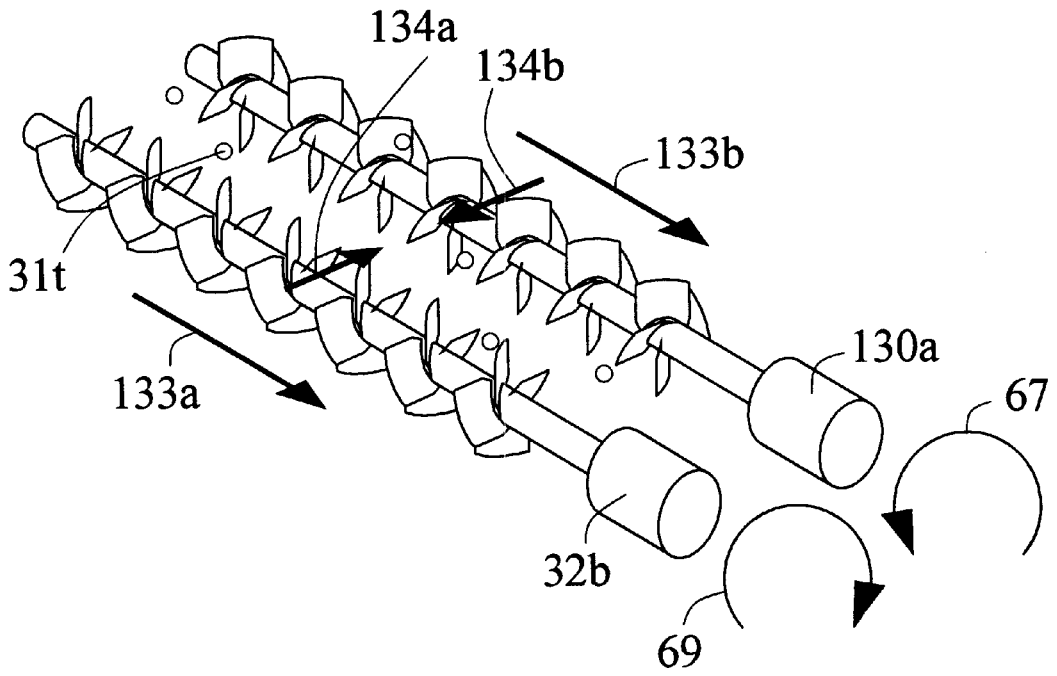
FIGS. 23A and 23B are partial perspective views of adjoining longitudinally mirror symmetrical rotary blade devices operating on granular material.
Figure 23B:
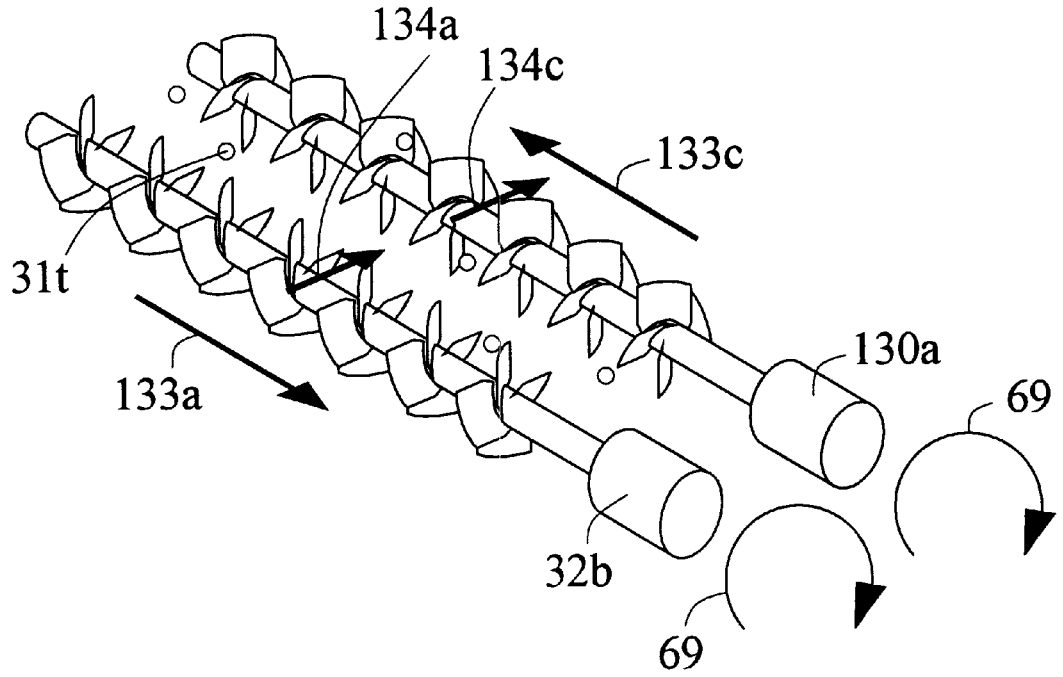

FIGS. 22, 23A and 23B illustrate the other preferred embodiment of the arrangement of the blade member and the rotary blade devices of the semi-fluid mattress of this invention.

If many rotary blade devices 32*b*, 130*a*, 32*d*, 130*b*, 32*f*, and 130*c* rotate in the same direction, the granular material tends to migrate in a longitudinal direction 37*x* of the frame 33*a*~33*b*. Because the impeller members 45*a* and 131*a* push the granular material 31*t* located above the channel 100*b* in the same longitudinal direction 37*x* of the frame 33*a*~33*b*. Thus, in this embodiment, the adjoining rotary blade devices 32*b* and 130*a* have substantially mirror symmetrical screw directions mutually in an arrangement of their blade members 132*a* and 132*b* in a longitudinal direction 37*x* of the frame 33*a*~33*b*, as illustrated in FIG. 22.

As illustrated in FIG. 23A, when these adjoining longitudinally mirror symmetrical rotary blade devices 32*b* and 130*a* transfer the granular material 31*t* from a transverse middle portion 54 to a transverse side portion 55*a* of the frame 33*a*~33*b*, or reversibly, as shown in arrows 133*a*~133*b*, rotating directions 69 and 67 of these adjoining rotary blade devices 32*b* and 130*a* are the opposite each other, so that the longitudinal migration of the granular material 31*t* is canceled to some extent as shown by arrows 134*a* and 134*b*.

Also, as illustrated in FIG. 23B, when these adjoining longitudinally mirror symmetrical rotary blade devices 32*b* and 130*a* rotate in the same direction as shown by arrow 69, the granular material 31*t* circulates transversely as shown in arrows 133*a* and 133*c* and migrates longitudinally as shown by arrows 134*a* and 134*c*. This operation intensifies the longitudinal migration of the granular material 31*t*. Because the granular material 31*t* migrates in either longitudinal direction without heavy migration in the transverse direction.

By canceling or intensifying the longitudinal migration of the granular material 31*t*, it further lessens a trouble for bed making. As similarly illustrated in FIG. 14B, these adjoining longitudinally mirror symmetrical rotary blade devices 32*b* and 130*a* can be placed in the same channel as the paired rotary blade devices.

Granular Material

Preferably, to control the thermal disharmony, the granular material should have low specific heat and low thermal conductivity. Preferably, to secure the strength, feel, and ventilation, the granular material should have sizes ranging from 1 mm to 3 mm. Preferably, the granular material should have a variety of shape and size so that a mass of granular material may obtain appropriate stability or instability in its arrangement. Preferably, the granular material should have a little elasticity to follow a slight moving of the user such as his breathing.

When the rotary blade devices are operated under the scanning control method, lighter grains, such as hollow structured grains, are usable to reduce the weight of the semi-fluid mattress.

The fluidity of a mass of granular material can be adjusted by mixing a hard and slippery granular material and less slippery granular material. The synthetic resin grains are usable for such hard and slippery granular material to simplify its production.

Ventilation for Airiness

Figure 24A:
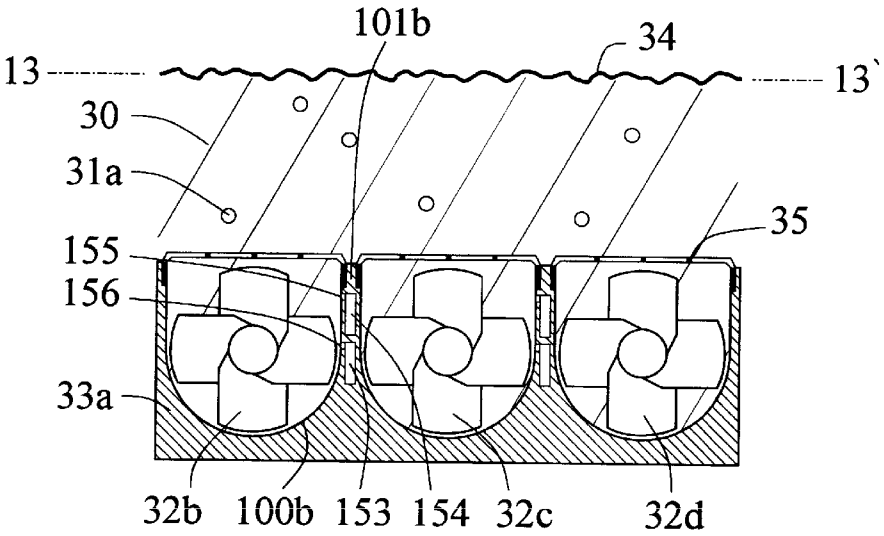
FIG. 24A is a partial vertical sectional view similar to FIG. 13, illustrating air ducts.
Figure 24B:
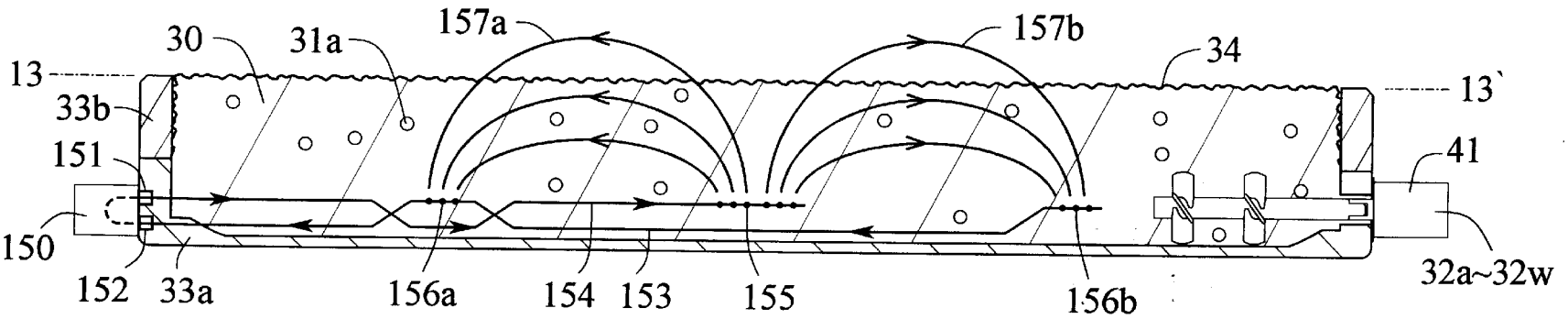
FIG. 24B is a schematic vertical sectional view similar to FIG. 5, illustrating air current for ventilation.

FIGS. 24A and 24B illustrate a preferred embodiment of an air circulating apparatus of the semi-fluid mattress of this invention. The air circulating apparatus mainly circulates the air transversely through the semi-fluid mattress.

An air pump 150 is installed in the frame 33*a*~33*b*. The air pump 150 has an intake 152 and an outlet 151. An inhaling duct 153 is connected to the intake 152 of the air pump 150. The inhaling duct 153 is placed along the channel 100*b*, preferably formed within a wall 101*b* of the channel 100*b*. An exhaling duct 154 is connected to the outlet 151 of the air pump 150. The exhaling duct 154 is placed along the channel 100*b*. Inhaling holes 156 are connected to the inhaling duct 153. The inhaling holes 156 are exposed to the granular material 31*a*. Exhaling holes 155 are connected to the exhaling duct 154. The exhaling holes 155 are exposed to the granular material 31*a*.

As illustrated in FIG. 24B, to make the air current 157*a* and 157*b* transversely circulating through the air permeable sheet 34 and the granular material 31*a*, the inhaling holes 156 (156*a*~156*b*) are located in the transverse side portions of the frame 33*a*~33*b* and the exhaling holes 155 are located in the transverse middle portion of the frame 33*a*~33*b*.

By driving the air pump 150, the user obtains good ventilation by the air current 157*a* and 157*b* which circulates from the back of the user to both sides of the mattress. Instead of the air permeable sheet 34, an air impermeable sheet with an air permeable area in its middle portion is applicable to keep warm by suppressing air leakage from its side portion while the air circulates.

It should also be understood that the forgoing relates to only preferred embodiments of the invention, and that it is intended to cover all changes and modifications of the example of the invention herein chosen for the purpose of the disclosure, which do not constitute departures from the spirit and scope of the invention.

What is claimed is:

1. A mattress comprising:

(a) a frame having a floor and a wall;

(b) a mass of granular material disposed in said frame;

(c) means for fluidizing said granular material, said fluidizing means independently controlling said fluidizing of said granular material at more than one location along a longitudinal dimension of said frame; and (d) means for transferring said granular material reversibly between a transverse middle portion and transverse side portions of said frame, said transferring means independently controlling said transferring of said granular material at more than one location along said longitudinal dimension of said frame.

2. A mattress comprising:

(a) a frame having a floor and a wall;

(b) a mass of granular material disposed in said frame;

(c) means for fluidizing said granular material, said fluidizing means independently controlling said fluidizing of said granular material at more than one location along a longitudinal dimension of said frame; and (d) means for transferring said granular material reversibly between a transverse middle portion and transverse side portions of said frame, said transferring means independently controlling said transferring of said granular material at more than one location along said longitudinal dimension of said frame;

wherein said fluidizing means and said transferring means jointly comprise:

more than one device supported by said frame, said devices being located within said longitudinal dimension of said frame, and each of said devices including:

(1) a shaft member rotatable on a rotatory axis oriented at an angle of from 60 to 120 degrees relative to a longitudinal axis of said frame; and (2) a blade member connected to said shaft member.

3. A mattress according to claim 2, wherein each of said devices further includes:

(3) means for rotating said shaft member reversibly.

4. A mattress according to claim 3, wherein said rotating means includes a driving motor connected to said shaft member.

5. A mattress according to claim 2, wherein each of said devices includes an impeller member composed of said blade member.

6. A mattress according to claim 2, wherein each of said devices includes a first blade member arranged on said shaft member within a first zone disposed between a central longitudinal axis of said frame and a first transverse side of said frame, said first zone having a transverse dimension which is at least 25% of a transverse dimension of said frame.

7. A mattress according to claim 6, wherein said first blade member has a uniform screw direction within said first zone.

8. A mattress according to claim 7, wherein each of said devices includes a second blade member arranged on said shaft member within a second zone disposed on a side of said central longitudinal axis opposite said first zone, wherein said second blade member has a uniform screw direction within said second zone, and wherein said screw direction of said first blade member is opposite said screw direction of said second blade member.

9. A mattress according to claim 2, wherein each of said devices includes a plurality of blade members arranged on said shaft member within a zone disposed between a central longitudinal axis of said frame and a transverse side of said frame, wherein said zone has a transverse dimension which is at least 25% of a transverse dimension of said frame, and wherein said blade members cooperate to move granular material passing through said zone when said shaft is rotated about said rotatory axis.

10. A mattress according to claim 2, further comprising:

(e) a partition supported in said frame, said partition being located between adjoining devices, and a vertical height of said partition being larger than an external radius of rotation of said blade member.

11. A mattress according to claim 2, wherein said floor has a channel on an upper side of said floor, said channel houses said device at least partially, and a vertical depth of said channel is larger than an external radius of rotation of said blade member.

12. A mattress comprising:

(a) a frame having a floor and a wall, said frame defining a zone on one side of a central longitudinal axis of said frame, said zone having a transverse length larger than 25% of a transverse dimension of said frame;

(b) a mass of granular material disposed in said frame;

(c) means for fluidizing said granular material, said fluidizing means independently controlling said fluidizing of said granular material at more than one location along a longitudinal dimension of said frame; and (d) means for transferring said granular material mainly in a direction oriented at an angle of from 60 to 120 degrees relative to a longitudinal axis of said frame, said transferring means reversibly moving said granular material passing through said zone, and said transferring means independently controlling said transferring of said granular material at more than one location along said longitudinal dimension of said frame.

13. A mattress according to claim 12, wherein said fluidizing means and said transferring means jointly comprise:

more than one device supported by said frame, said devices being located within said longitudinal dimension of said frame, and each of said devices including:

(1) a shaft member rotatable on a rotatory axis oriented at an angle of from 60 to 120 degrees relative to said longitudinal axis of said frame; and (2) a blade member connected to said shaft member.

14. A mattress comprising:

(a) a frame having a wall and a floor having a channel on an upper side of said floor, said channel being oriented an angle of from 60 to 120 degrees relative to a longitudinal axis of said frame;

(b) a mass of granular material disposed in said frame; and (c) more than one device supported by said frame, said devices being located at spaced locations along a longitudinal dimension of said frame, each of said devices being housed in one of said channels at least partially, and each of said devices including:

(1) a shaft member rotatable on a rotatory axis substantially parallel to said channel; and (2) a blade member connected to said shaft member, said blade member being arranged on said shaft member within a zone disposed between a central longitudinal axis of said frame and a transverse side of said frame, said zone having a transverse dimension which is at least 25% of a transverse dimension of said frame, said zone defining a blade union including all of said blade member within said zone, and said blade union moving said granular material passing through said zone; and (3) means for rotating said shaft member reversibly; and wherein:

a vertical depth of said channel is larger than an external radius of rotation of said blade member.

15. A mattress according to claim 14, wherein respective blade members of adjoining devices have substantially mirror symmetrical screw directions.

16. A mattress according to claim 14, wherein rotating directions of adjoining devices are opposite each other when said adjoining devices transfer said granular material from a transverse middle portion to a transverse side portion of said frame.

17. A mattress according to claim 14, further comprising: a safety net member connected to an upper side of a wall of said channel.

18. A semi fluid mattress comprising:

(a) a frame having a floor and a wall;

(b) a partition supported in said frame, said partition being oriented at an angle of from 60 to 120 degrees relative to a longitudinal axis of said frame;

(c) a mass of granular material disposed in said frame; and (d) more than one device supported by said frame, said devices being located at spaced locations along a longitudinal extent of said frame, wherein an adjoining pair of said devices are separated by said partition, and each of said devices including:

(1) a shaft member rotatable on a rotatory axis substantially parallel to said partition, said frame defining a zone on said shaft member between a central longitudinal axis of said frame and a transverse side of said frame, said zone having a transverse dimension which is at least 25% of a transverse dimension of said frame; and (2) a blade member connected to said shaft member, said zone defining a blade union including all of said blade member within said zone, and said blade union moving said granular material passing through said zone; and (3) means for rotating said shaft member reversibly; and wherein:

a vertical height of said partition is larger than an external radius of rotation of said blade member.

19. A mattress according to claim 18, further comprising:

(e) an air permeable sheet connected to said wall of said frame; and wherein:

said partition, said air permeable sheet further connected to said partition, and said frame defines a cell surrounded therein, said cell holding a part of said mass of granular material.

20. A mattress comprising:

(a) a frame having a floor and a wall;

(b) a mass of granular material held in said frame; and (c) more than one device supported by said frame, said devices being arranged at longitudinally spaced locations along a longitudinal dimension of said frame, and each of said devices including:

(1) a shaft member rotatable about a rotatory axis oriented at an angle of from 60 to 120 degrees relative to a longitudinal axis of said frame;

(2) a blade member connected to said shaft member, said blade member having a substantially uniform screw direction within a zone between a central longitudinal axis of said frame and a transverse side of said frame, wherein a length of said zone is larger than 25% of a transverse dimension of said frame; and (3) means for rotating said shaft member reversibly.

* * * * *